US009239184B2

(12) United States Patent
Kwon et al.

(10) Patent No.: US 9,239,184 B2
(45) Date of Patent: Jan. 19, 2016

(54) REFRIGERATOR

(71) Applicant: LG Electronics Inc., Seoul (KR)

(72) Inventors: Hongsik Kwon, Seoul (KR); Sanghun Kim, Seoul (KR); Seonkyu Kim, Seoul (KR); Hyokku Kwon, Seoul (KR); Sungkyong Han, Seoul (KR); Hangbok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/592,579

(22) Filed: Jan. 8, 2015

(65) Prior Publication Data

US 2015/0123532 A1 May 7, 2015

Related U.S. Application Data

(62) Division of application No. 13/628,778, filed on Sep. 27, 2012, now Pat. No. 8,960,825.

(30) Foreign Application Priority Data

Oct. 4, 2011 (KR) ..... 10-2011-0100892
Dec. 15, 2011 (KR) ..... 10-2011-0135822

(51) Int. Cl.

| | |
|---|---|
| ***F25D 23/12*** | (2006.01) |
| ***F25D 23/04*** | (2006.01) |
| ***F25D 25/02*** | (2006.01) |
| ***F25D 11/00*** | (2006.01) |
| ***F25D 23/00*** | (2006.01) |
| ***F25D 11/02*** | (2006.01) |
| ***F25D 23/02*** | (2006.01) |
| *F25D 25/04* | (2006.01) |
| *A47B 51/00* | (2006.01) |
| *A47B 57/06* | (2006.01) |

(52) U.S. Cl.

CPC ..... *F25D 23/12* (2013.01); *F25D 11/00* (2013.01); *F25D 11/02* (2013.01); *F25D 23/00* (2013.01); *F25D 23/025* (2013.01); *F25D 23/04* (2013.01); *F25D 25/02* (2013.01); *A47B 51/00* (2013.01); *A47B 57/06* (2013.01); *F25D 25/04* (2013.01)

(58) Field of Classification Search

CPC .... F25D 23/04; F25D 25/02; F25D 2323/023
USPC ..... 312/405.1, 408, 321.5, 291, 292
See application file for complete search history.

(56) References Cited

U.S. PATENT DOCUMENTS 2,373,029 A 4/1945 Kiesling
3,316,044 A 4/1967 Carbary (Continued)

FOREIGN PATENT DOCUMENTS

EP 307565 A 3/1989
JP 62241169 A 10/1987

(Continued)

*Primary Examiner* — Hanh V Tran
(74) *Attorney, Agent, or Firm* — Dentons US LLP

(57) ABSTRACT

A refrigerator includes: a refrigerator main body having a cooling chamber; a cooling chamber door for opening and closing the cooling chamber; a shelf assembly provided within the cooling chamber such that a height thereof is adjustable; and a basket provided in any one of the refrigerator main body and the cooling chamber door such that a height thereof is adjustable. A space of the refrigerator main body or the cooling chamber door can be utilized to facilitate receiving and keeping food items.

20 Claims, 24 Drawing Sheets

(56) References Cited

U.S. PATENT DOCUMENTS

| | | | | | |
|---|---|---|---|---|---|
| 3,982,801 | A * | 9/1976 | Heidorn | A47B 57/06 | 108/147 |
| 4,064,675 | A | 12/1977 | Stapp et al. | | |
| 4,161,234 | A | 7/1979 | Munn | | |
| 4,171,789 | A * | 10/1979 | Vander Hoek | A47B 57/42 | 108/108 |
| 4,217,010 | A | 8/1980 | Webb | | |
| 4,625,657 | A | 12/1986 | Little et al. | | |
| 4,667,605 | A | 5/1987 | Bastian | | |
| 4,993,905 | A | 2/1991 | Potocnjak | | |
| 5,199,778 | A * | 4/1993 | Aoki | A47B 57/32 | 108/147 |
| 5,913,584 | A | 6/1999 | Swindell et al. | | |
| 6,065,821 | A * | 5/2000 | Anderson | A47B 57/06 | 108/108 |
| 6,363,738 | B2 | 4/2002 | Nakajima et al. | | |
| 6,582,038 | B2 * | 6/2003 | Moreno-Olguin | F25D 23/04 | 312/321.5 |
| 7,748,805 | B2 * | 7/2010 | Lucas | F25D 23/04 | 312/405.1 |
| 8,047,623 | B2 | 11/2011 | Kang et al. | | |
| 8,123,314 | B2 * | 2/2012 | Becke | F25D 23/04 | 108/107 |
| 8,342,619 | B2 * | 1/2013 | Seo | F25D 23/04 | 312/247 |
| 8,376,482 | B2 | 2/2013 | An et al. | | |
| 2003/0215357 | A1 | 11/2003 | Malterer et al. | | |
| 2004/0255607 | A1 * | 12/2004 | Barmann | A47B 57/562 | 62/407 |
| 2007/0096610 | A1 | 5/2007 | Filho et al. | | |
| 2007/0159041 | A1 * | 7/2007 | Lucas | F25D 23/067 | 312/408 |
| 2007/0176528 | A1 | 8/2007 | Lee et al. | | |
| 2008/0203041 | A1 | 8/2008 | Lim et al. | | |
| 2008/0246382 | A1 * | 10/2008 | Kang | A47B 57/06 | 312/408 |
| 2008/0251483 | A1 | 10/2008 | Davis et al. | | |
| 2009/0058247 | A1 | 3/2009 | Collins et al. | | |
| 2009/0121600 | A1 | 5/2009 | Eisele et al. | | |
| 2009/0308098 | A1 | 12/2009 | An et al. | | |
| 2010/0066227 | A1 | 3/2010 | Ramm et al. | | |
| 2010/0133970 | A1 * | 6/2010 | Shin | F25D 25/02 | 312/408 |
| 2010/0164342 | A1 * | 7/2010 | Hagele | A47B 57/425 | 312/408 |
| 2010/0176702 | A1 * | 7/2010 | Kim | F25D 23/04 | 312/405.1 |
| 2010/0176703 | A1 | 7/2010 | Kim | | |
| 2010/0270251 | A1 * | 10/2010 | Mejac | A47B 57/265 | 211/134 |
| 2011/0031863 | A1 | 2/2011 | Benitsch et al. | | |
| 2011/0290807 | A1 * | 12/2011 | Calvillo | F25D 25/02 | 220/592.02 |

FOREIGN PATENT DOCUMENTS

| | | | |
|---|---|---|---|
| JP | 02163208 | A | 6/1990 |
| JP | 2004173959 | A | 6/2004 |

* cited by examiner

REFRIGERATOR

This application is a Divisional of application Ser. No. 13/628,778 filed on Sep. 27, 2012, which claims benefit of Korean Application No. 10/2011-0100892 filed on Oct. 4, 2011 and 10-2011-0135822, filed on Dec. 15, 2011, all of which are herein expressly incorporated by reference in their entireties.

FIELD OF THE INVENTION

The present invention relates to a refrigerator and, more particularly, to a refrigerator allowing for easily receiving and keeping food items by utilizing space.

DESCRIPTION OF THE RELATED ART

As known, a refrigerator is a device for keeping food items fresh in a refrigerated state or frozen state.

A refrigerator may include, for example, a refrigerator main body having a cooling chamber, a cooling chamber door for opening and closing the cooling chamber, and a refrigerating cycle device providing cold air to the cooling chamber.

The refrigerating cycle device may be configured as a so-called vapor compression type refrigerating cycle device including a compressor for compressing a refrigerant, a condenser for radiating (or condensing) a refrigerant, an expansion device for decompressing and expanding a refrigerant, and an evaporator allowing a refrigerant to absorb ambient latent heat so as to be evaporated.

FIG. 1 is a perspective view illustrating an interior of a related art refrigerator.

As illustrated in FIG. 1, the refrigerator includes a refrigerator main body 10 having a cooling chamber 20 provided therein and a cooling chamber door 30 for opening and closing the cooling chamber 20.

The cooling chamber 20 is configured to be spaced apart in a horizontal direction or vertical direction of the refrigerator main body 10.

The cooling chamber 20 includes a freezing chamber 21 and a refrigerating chamber 22.

The cooling chamber door 30 includes a freezing chamber door 31 and a refrigerating chamber door 32.

The cooling chamber door 30 includes a plurality of door baskets 41 and 42 for receiving and keeping food items or articles.

The door baskets 41 and 42 are detachably coupled to the freezing chamber door 31 and the refrigerating chamber door 32, respectively.

Meanwhile, a shelf 35 is provided in the cooling chamber 20.

A plurality of shelves 35 are provided.

The shelves 35 may be disposed to be spaced apart from each other in a vertical direction of the cooling chamber 20.

The shelf 35 may be formed to have, for example, a rectangular plate shape.

A shelf support portion 37 is formed on both side walls of the cooling chamber 20 in order to support the shelves 35.

The shelf support portion 37 may be configured as a protrusion 38 protruded from the side wall of the cooling chamber 20. Here, the shelf support portion 37 may be configured as a recess formed to be depressed on a wall surface of the cooling chamber 20.

The shelf support portions 37 are disposed to be spaced apart from each other in a vertical direction of the cooling chamber 20.

Meanwhile, in order to keep a food item which is greater than a vertical interval between the vertically separated shelves 35, a height of the shelf 35 (or an interval between the shelves 35) disposed up and d own is required to be adjusted.

However, in the related art refrigerator, when the shelf 35 is intended to be adjusted in height, food items placed on the upper and/or lower shelves 35 are all taken out from upper surfaces of the corresponding shelf 35, the corresponding shelf 35 is separated from the shelf support portion 37, and then, the separated shelf 35 is moved in a direction it is away from an upper side and/or lower side, thus adjusting the height of the shelf. Also, after the height of the shelf 35 is adjusted, the food items, which were taken out from the shelf moved for adjustment of the height thereof, should be returned, making the adjustment of height of the shelf 35 very cumbersome. Namely, in the related art refrigerator, in order to the adjust the height of the shelf 35, the process of separating and re-installing the shelf 35 and the process of taking out and returning food items are required to be performed, so the adjustment of the height of the shelf is inconvenient.

In addition, the respective door baskets 41 and 42 are fixedly disposed at pre-set positions, when an item or an article is put therein, a height as well as a width thereof should be considered, causing inconvenience.

In addition, when an item having a height greater than a vertical interval of the door baskets 41 and 42 is inclined to be kept therein, a dead volume is generated to prevent utilization of a full space. Also, content of the item inclined to be kept may be leaked to the outside.

SUMMARY OF THE INVENTION

An aspect of the present invention provides a refrigerator in which food items can be easily kept by utilizing a space of a refrigerator main body or a cooling chamber door.

Another aspect of the present invention provides a refrigerator having a shelf assembly whose height is adjustable without having to taken out food items placed on an upper surface of a shelf.

Another aspect of the present invention provides a refrigerator in which a height of a shelf can be minutely adjusted.

Another aspect of the present invention provides a refrigerator having a shelf assembly that can be simply separated and assembled and easily cleaned.

Another aspect of the present invention provides a refrigerator having a shelf assembly whose height is adjustable manually without using an electric component.

Another aspect of the present invention provides a refrigerator in which a height of a basket is adjusted to correspond to a height of an article or a food item received therein, thus facilitating reception or accommodation of an article or a food item.

Another aspect of the present invention provides a refrigerator in which a basket is smoothly moved and a height of a basket can be simply adjusted.

According to an aspect of the present invention, there is provided a refrigerator including: a refrigerator main body having a cooling chamber; a cooling chamber door for opening and closing the cooling chamber; and a shelf assembly provided within the cooling chamber such that a height thereof is adjustable, or a basket provided in any one of the refrigerator main body and the cooling chamber door such that a height thereof is adjustable.

The shelf assembly may include: a panel; protrusions provided on both sides of the panel such that they are relatively movable with respect to the panel; a guide for guiding the protrusions such that the protrusions ascends and descends;

and a height adjusting unit for moving the protrusions forwardly and backwardly with respect to the panel to adjust a height of the panel.

The panel may include; a cover; a frame supporting the cover; and a slider slidably moved on both sides of the frame, wherein the protrusions are provided on the slider.

The height adjusting unit may include: a shaft rotatably disposed in the frame, a power transmission unit for transmitting rotatory power of the shaft to the slider to move the slider, and a rotary handle for rotating the shaft.

The power transmission unit may include a first pulley provided at both end portions of the shaft and disposed on one side of each slider, a second pulley disposed on the other side of the slider, and a belt coupled to the first pulley and the second pulley and connected to the slider.

The rotary handle may be provided on a bottom portion of the frame.

The height adjusting unit may include a lead screw disposed in a movement direction of each slider, a female screw unit screw-coupled to the lead screw and provided on the slider, and a lead screw driving unit for rotating the lead screw.

The lead screw driving unit may include a pulley provided in each lead screw, a belt coupled to the pulley, and a handle connected to the belt to rotate the belt.

The guide may include an entrance allowing the protrusion to be inserted therein or drawn out therefrom.

A guide coupling portion may be provided on an inner wall of the cooling chamber, to which the guide is detachably coupled.

The guide may include a guide main body having a plate-like shape and a guiding unit formed to be sloped to guide the protrusions accommodated in the guide main body to ascend and descend.

A plurality of shelves may be provided in an upper side or a lower side of the shelf assembly, a shelf support member may be further provided to be coupled to the guide coupling portion to support any one of the shelves when the shelf assembly is separated.

The shelf support member may include a plurality of support protrusions spaced apart vertically and selectively supporting the shelf.

The refrigerator may further include a height adjusting unit for adjusting a height of ascending and descending of the basket, wherein rails may be provided on the refrigerator main body or the cooling chamber door such that they are spaced apart from one another and disposed in an ascending and descending direction of the basket to guide the basket.

The rail may have stop portions formed at a pre-set interval, and the height adjusting unit may include a latch rotatable between an engagement position at which the latch is engaged with the stop portion in a vertical direction and a release position at which the engagement thereof is released; and a manipulation lever provided on one side of the latch and releasing the engagement of the latch when manipulated to be pressed.

The rail may have an annular section having a slit formed in a length direction on one side thereof, and the basket may include a support portion having one side inserted in the rail to movably support the basket.

A partition may be disposed to partition an internal space of the rail, and the stop portion may include a stop recess formed to penetrate the partition.

The latch may have a stop protrusion inserted in the stop recess.

An elastic member may be further provided to apply elastic force to move the latch toward the stop portion.

The manipulation lever may include a rotational shaft, a driving arm extending from the rotational shaft toward the latch to rotate the latch, and a handle disposed on the other side of the driving arm based on the rotational shaft interposed therebetween.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiments of the present invention will be described in detail with reference to the accompanying drawings.

Figure 1:
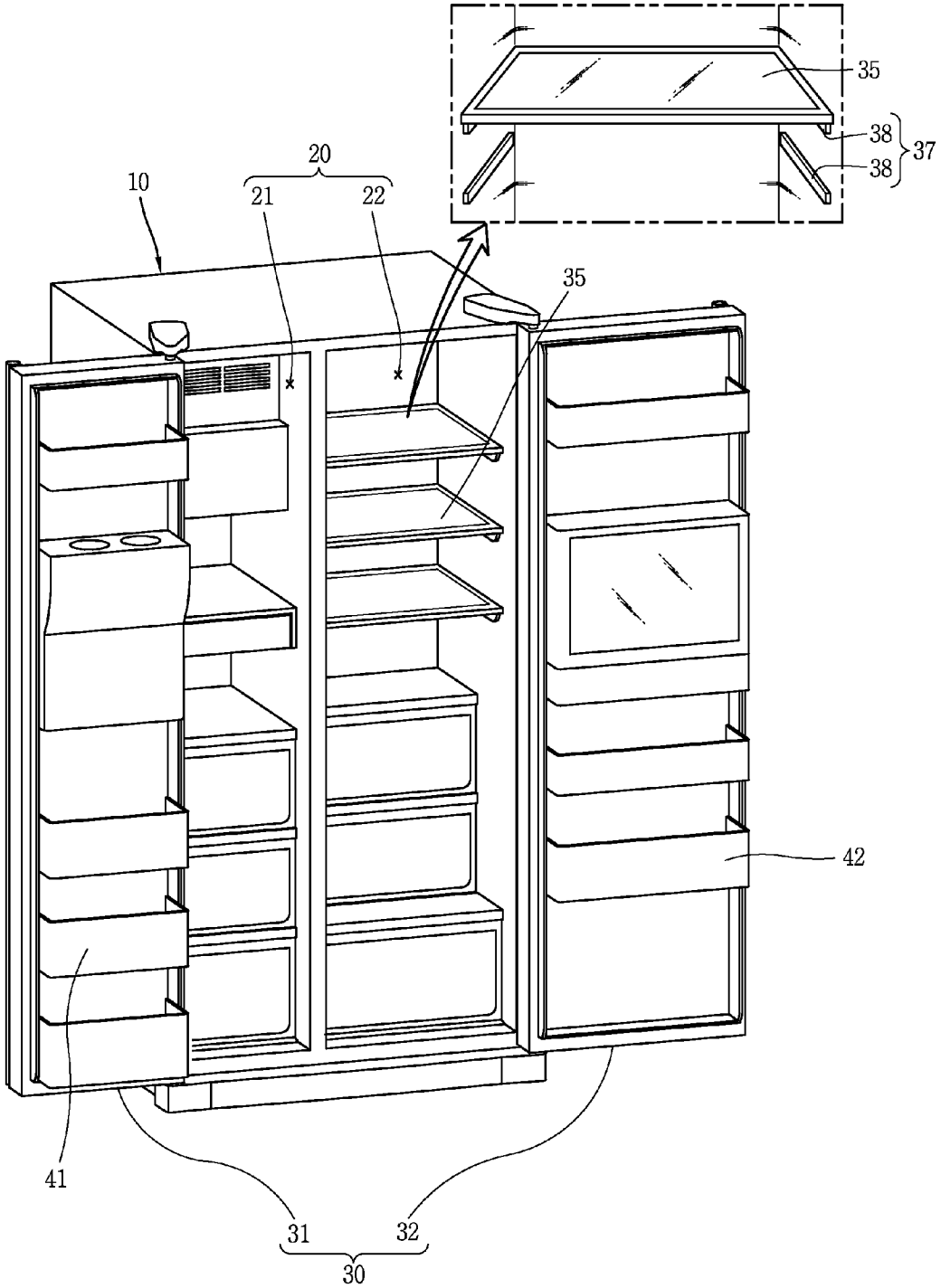
FIG. 1 RELATED ART
FIG. 1 is a perspective view showing the interior of a related art refrigerator.
Figure 2:
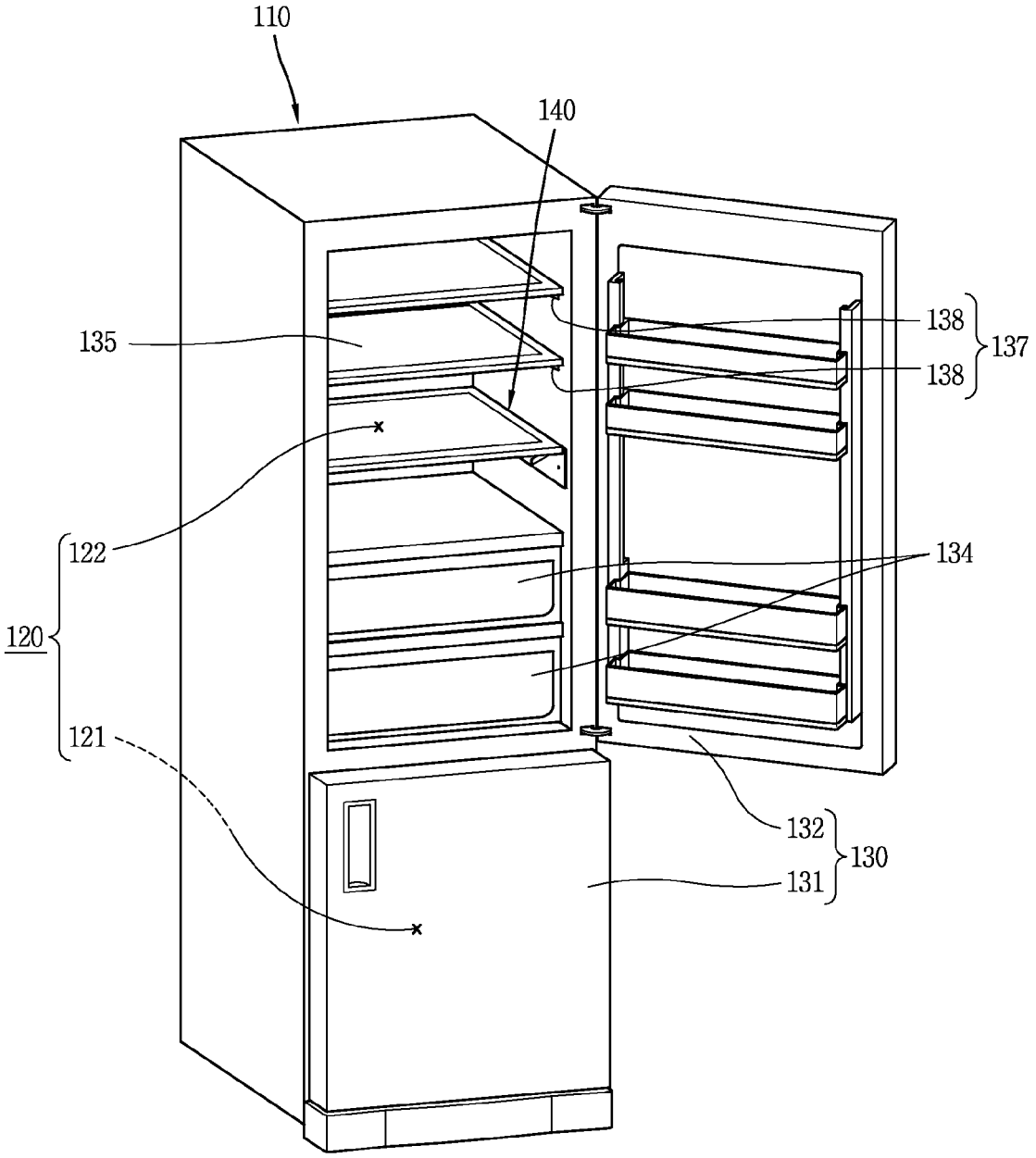
FIG. 2 is a perspective view of a refrigerator having a height-adjustable shelf assembly according to an embodiment of the present invention.
Figure 3:
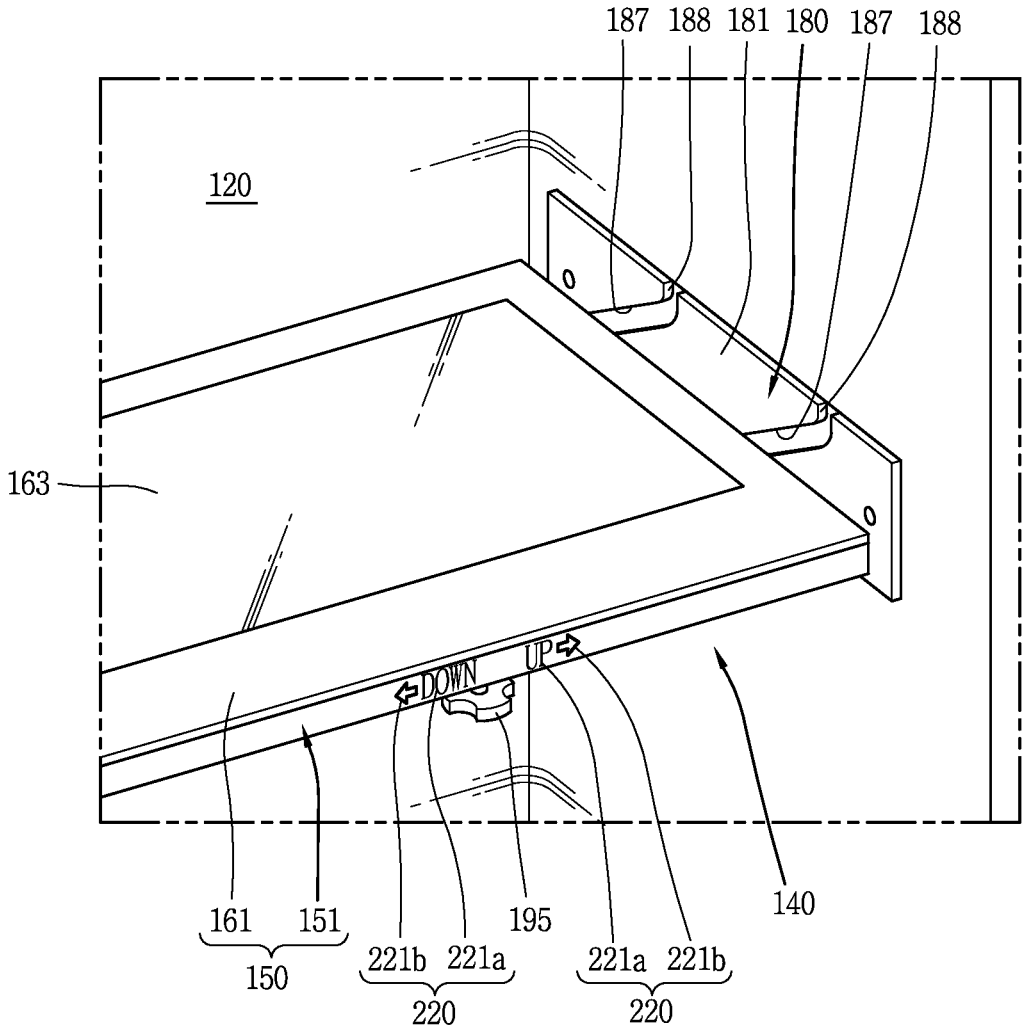
FIG. 3 is a perspective view of the shelf assembly of FIG. 2.

As shown in FIGS. 2 and 3, a refrigerator having a height adjustable shelf assembly according to an embodiment of the present invention may include a refrigerator main body 110 having a cooling chamber 120, a cooling chamber door 130 for opening and closing the cooling chamber 120, and a height adjustable shelf assembly 140 provided within the cooling chamber 120 according to an embodiment of the present invention. Here, the cooling chamber 120 may generally refer to a space in which food items are cooled and kept in storage. The cooling chamber 120 may include a freezing chamber 121 and a cooling chamber 122. The refrigerator main body 110 may include any one of the freezing chamber 121 and the refrigerating chamber 122.

The refrigerator main body 110 may include the cooling chamber 120 with an open front side.

The cooling chamber 120 may include the freezing chamber 121 and the refrigerating chamber 122. Here, the refrigerator main body 110 may be configured as a so-called bottom freezer in which the refrigerating chamber 122 is formed in an upper portion of the refrigerator main body 110 and the freezing chamber 121 is disposed in a lower portion thereof. Also, the refrigerator main body 110 may be configured as a so-called top freezer in which the freezing chamber 121 is formed in an upper portion thereof and the refrigerating chamber 122 is formed in a lower portion thereof. Also, the refrigerator main body 110 may be configured as a side-by-side type freezer in which the freezing chamber and the refrigerating chamber are disposed in a horizontal direction.

A drawer 134 may be provided in a lower portion therein.

A plurality of shelves 135 may be provided within the cooling chamber 120 in order to support food items received and kept thereon.

The shelf 135 may be configured to have a substantially rectangular plate shape.

The shelf 135 may be configured to have a length corresponding to a horizontal width of the cooling chamber 120.

A shelf support portion 137 may be provided on both side walls of the cooling chamber 120 in order to supply the shelf 135, respectively.

The shelf support portion 137 may include, for example, a plurality of support protrusions 138.

The support protrusions 138 may be configured to be protruded from both side walls of the cooling chamber 120.

The support protrusions 138 may be configured to be protruded from both side walls of the cooling chamber 120 and extend in a forward/backward direction.

In detail, the support protrusions 138 may be configured to be spaced apart in a forward/backward direction of the cooling chamber 120 and have the same height.

Meanwhile, the height-adjustable shelf assembly 140 (referred to as a 'shelf assembly 140', hereinafter), which is adjustable in height, according to an embodiment of the present invention may be provided within the cooling chamber 120. In the present embodiment, a case in which one shelf assembly 140 is provided within the cooling chamber 120 is illustrated, but the number of shelf assemblies 140 may be appropriately adjusted.

The shelf assembly 140 may include a panel 150, protrusions 175 provided on both sides of the panel 150 such that they are relatively movable forwardly and backwardly with respect to the panel 150, a guide 180 for guiding the protrusions 175 such that they ascend and descend, and a height adjusting unit 190 for moving the protrusions 175 forwardly and backwardly with respect to the panel 150 to adjust a height of the panel 150.

The panel 150 may be configured as a rectangular plate shape.

The panel 150 may be configured to have a length corresponding to a horizontal width of the cooling chamber 120.

The panel 150 may be configured to have such strength sufficient to support food items received and kept on an upper surface thereof.

The panel 150 may be configured, for example, as a synthetic resin member.

In detail, the panel 150 may include a cover 161, a frame 151 supporting the cover 161, and a slider 171 slidably moving forwardly and backwardly on both sides of the frame 151.

The cover 161 may be formed to have a rectangular plate shape having a relatively small thickness.

The frame 151 may be formed to have a rectangular plate shape having a thickness greater than that of the cover 161.

The cover 161 may be provided on an upper surface of the frame 151.

The cover 161 and the frame 151 may be configured to be coupled in a vertical direction.

Figure 4:
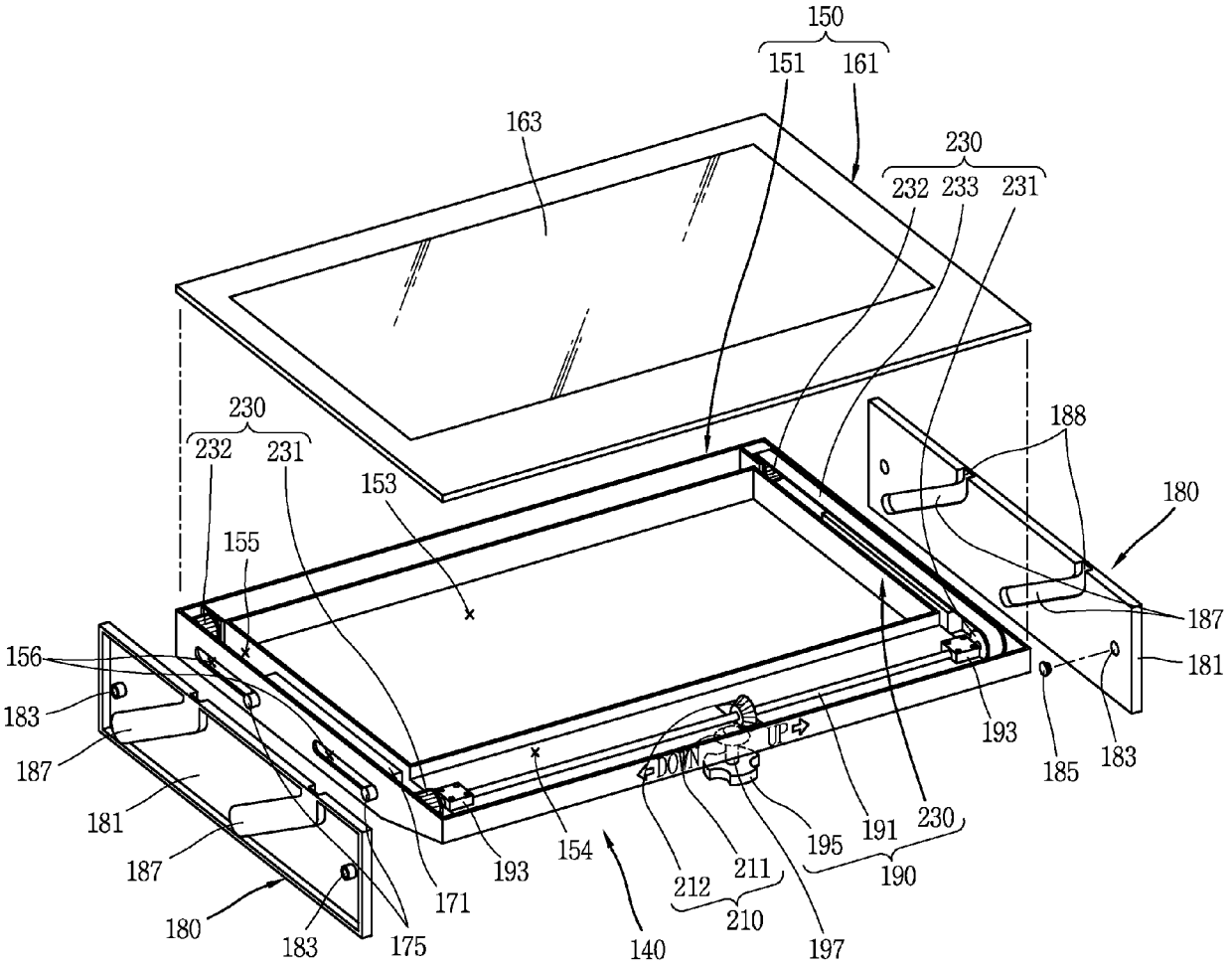
FIG. 4 is an exploded perspective view of the shelf assembly of FIG. 3.
Figure 5:
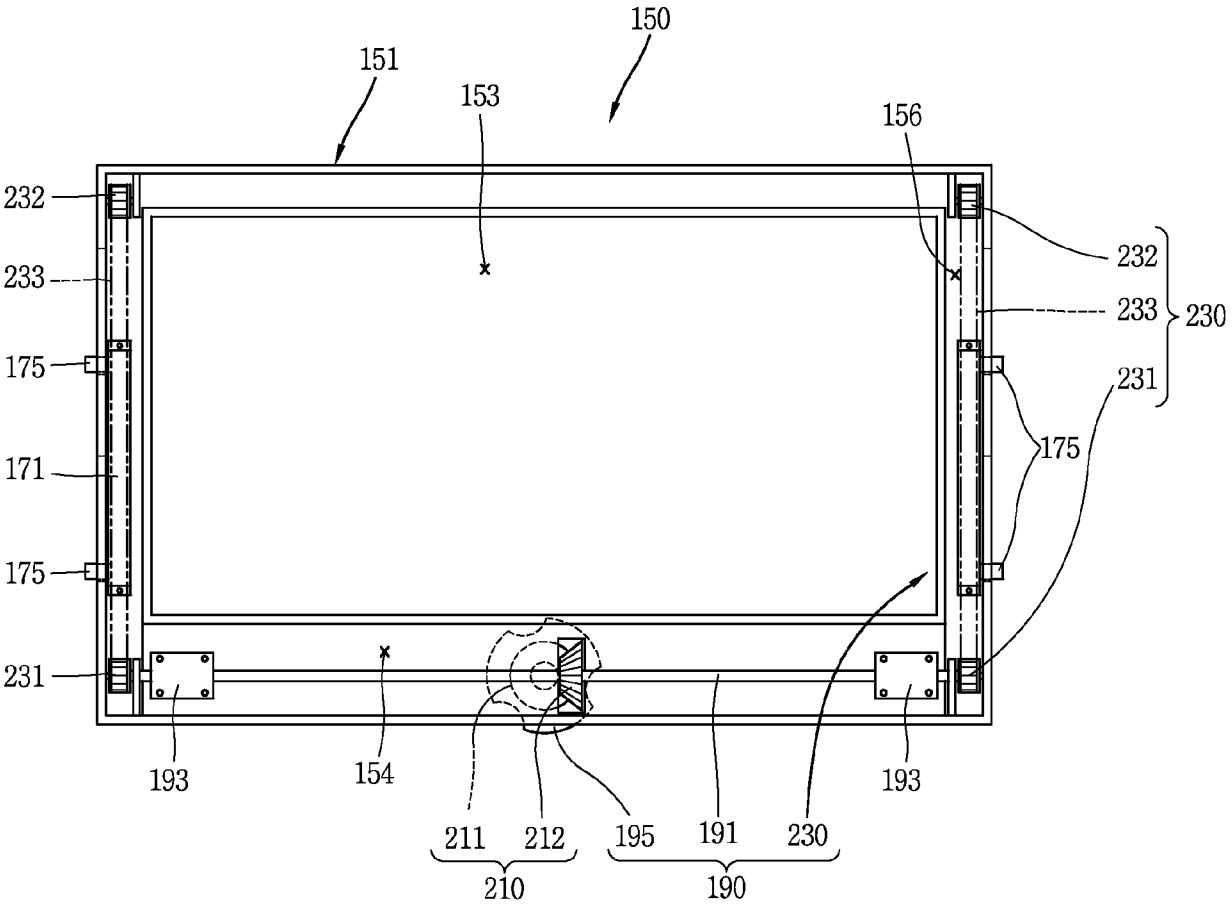
FIG. 5 is a plan view of FIG. 2.

As shown in FIGS. 4 and 5, the frame 151 may have an opening 153 formed at a central portion thereof.

The opening 153 may have a size smaller than the frame 151.

A predetermined accommodation space 154 may be provided on a circumference of the opening 153. For example, accommodation space 154 may be provided at both sides of the opening 153 in a length direction and at one side (i.e., a front region) of the opening 153 in a width direction. In the present embodiment, a case in which the accommodation space 154 is formed at four sides of the opening 153 is illustrated.

The cover 161 may include, for example, a light-transmissive window or a transparent window 163 (referred to as a 'transparent window 163', hereinafter).

The transparent window 163 may be configured to correspond to the opening 153. Accordingly, when the shelf assembly 140 is installed, light of illumination may pass through the transparent window 163 and the opening 153, thus preventing a lower side (or space) of the shelf assembly 140 from being darkened.

The slider 171 may be provided on both side regions of the frame 151 such that the slider 171 is slidably movable in a width direction of the frame 151.

The slider 171 may be configured as, for example, rectangular parallelepiped.

A slider accommodation portion 155 may be provided on both sides of the frame 151, to allow the slider 171 to be accommodated therein and slidably moved in a forward/backward direction.

Each slider 171 may be configured to be accommodated in the corresponding slider accommodation portions 155 and moved in a forward/backward direction between a descending position and an ascending position. For example, the descending position may be a position at which the slider 171 has been moved to a rear side (or a rear end) of the slider accommodation portion 155, and the ascending position may be a position at which the slider 171 has been moved to a front side (or a front end) of the corresponding slider accommodation portion 155.

The protrusion 175 may be provided on one side (or an outer side) of the slider 171.

A protrusion accommodation portion 156 may be formed on one side wall (or an outer wall) of the slider accommodation portion 155, in order to allow the protrusion 175 to pass therethrough.

For example, the protrusion accommodation portion 156 may be formed along a movement path of the protrusion 175 to allow the protrusion 175 to be accommodated therein and moved forwardly and backwardly.

The slider 171 may include a plurality of protrusions 175. Accordingly, the panel 150 may be horizontally maintained and stably supported.

The protrusions 175 may be configured to be spaced apart in a length direction of the slider 171.

Meanwhile, the guide 180 may be provided on both sides of the panel 150 in order to guide the protrusion 175 such that the protrusion 175 ascends and descends.

The guide 180 may be configured to have a substantially rectangular plate shape.

The guide 180 may be provided on both side walls of the cooling chamber 120.

Figure 8:
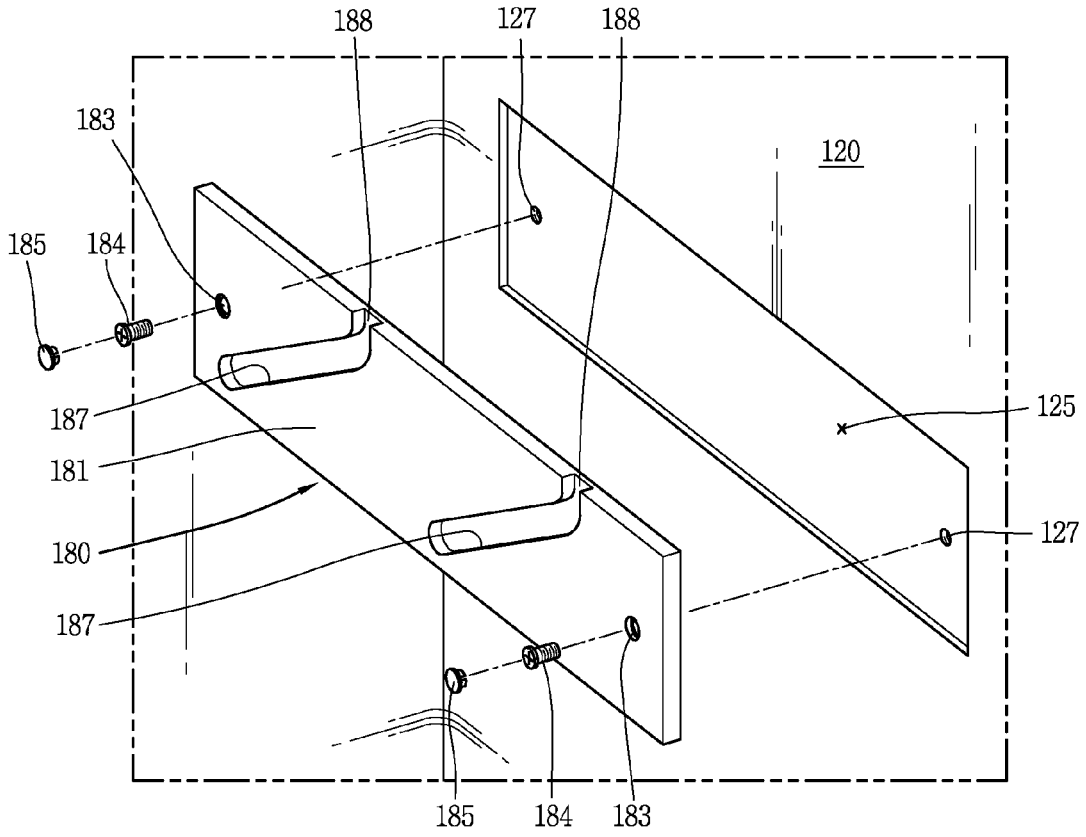
FIG. 8 is a perspective view before a guide is coupled in FIG. 2

As shown in FIG. 8, the guide 180 may include a guide main body having a rectangular plate shape and a guiding portion 187 formed to be sloped on the guide main body 181 to accommodate the protrusion 175 and guide the protrusion 175 to ascend and descend.

An entrance 188 may be provided on an upper end of the guiding portion 187 to allow the protrusion 175 to enter.

The entrance 188 may be formed to be open toward an outer side (or an upper side) of the guide main body 181.

The entrance 188 may be disposed in a vertical direction and has a certain length. Accordingly, the protrusion 175 is prevented from being abruptly separated from the guide 180, when being manipulated.

The guiding portion 187 may be formed to be upwardly sloped from a lower side to an upper side in a length direction. Accordingly, the protrusion 175 disposed on a lower side of the guiding portion 187 may be upwardly moved along the guiding portion 187.

In detail, the guiding portion 187 may be formed to be downwardly sloped from a lower end of the entrance 188 to a rear side. Namely, the guide 180 is disposed on both side walls of the cooling chamber 120 in a forward/backward direction, and in this case, the guiding portion 187 may be formed to extend to be downwardly sloped from the entrance 188 to a rear side.

The guiding portion 187 may be configured to have a length corresponding to a forward/backward movement distance of the protrusion 175.

The guiding portion 187 may be formed to penetrate the guide main body 181. Here, the guiding portion 187 may be depressed in a thickness direction from a plate surface (i.e., one wide and flat surface or an inner surface) of the guide main body 181 and slopingly extend.

Meanwhile, a guide coupling portion 125 may be provided on both side walls of the cooling chamber 120, to which the guide 180 is detachably coupled.

For example, the guide coupling portion 125 may be configured to be depressed inwardly in a thickness direction from an inner wall (or an inner surface) of the cooling chamber 120. Here, a degree (or depth) of depression of each guide coupling portion 125 may be appropriately adjusted. The guide 180 and the guide coupling portion 125 may be configured such that the protrusion 175 of the shelf assembly 140 is separated and coupled through the entrance 188 in a state in which the ach guide 180 is coupled.

The guide coupling portion 125 may include a fastening member coupling portion 127 allowing a fastening member (e.g., a bolt or a screw) 184 to coupled thereto through the guide 180.

The fastening member coupling portion 127 may be configured as, for example, a female screw portion.

The guide 180 may include a fastening member coupling hole 183 allowing the fastening member 184 to pass therethrough.

The fastening member 184 may be configured such that a head portion thereof is inserted into the fastening member coupling hole 183. Accordingly, interference resulting from protrusion of the fastening member 184 can be restrained.

A cap 185 may be detachably coupled to the fastening member coupling hole 183. Accordingly, a foreign object is prevented from being introduced into the fastening member coupling hole 183.

The cap 185 may be formed as a rubber member or a synthetic resin member.

Preferably, the cap 185 is configured such that it is not protruded from the guide 180, after being coupled.

Meanwhile, the height adjusting unit 190 may be provided on the panel 150 in order to adjust a height of the panel 150 by moving the protrusion 175.

The height adjusting unit 190 may include, for example, a shaft 191 rotatably disposed on the frame 151, a power transmission unit 230 for transferring rotatory power of the shaft 191 to the slider 171 to move the slider 171, and a rotary handle 195 for rotating the shaft 191.

For example, the shaft 191 may be disposed in a front region of the frame 151 in a length direction.

The shaft 191 may have a length sufficient to allow both end portions thereof to be disposed in a front region of the slider 171, respectively.

The shaft 191 may be rotatably supported.

For example, a rotary support portion 193 may be provided on both end portions of the shaft 191 in order to rotatably support the shaft 191.

The rotary handle 195 may be rotatably installed on the panel 150.

As shown in FIG. 3, the rotary handle 195 may be provided on a central bottom surface of the panel 150.

The rotary handle 195 may include a rotational shaft 197.

A rotary handle support portion 198 rotatably supporting the rotary handle 195 may be provided on the panel 150. The rotary handle support portion 198 may rotatably support the rotational shaft 197 of the rotary handle 195.

A power transmission gear 210 for transferring rotatory power of the rotary handle 195 to the shaft 191 may be provided between the rotary handle 195 and the frame 151. For example, the power transmission gear 210 may be configured such that rotational shafts of respective power transmission gears are perpendicular to each other.

Figure 6:
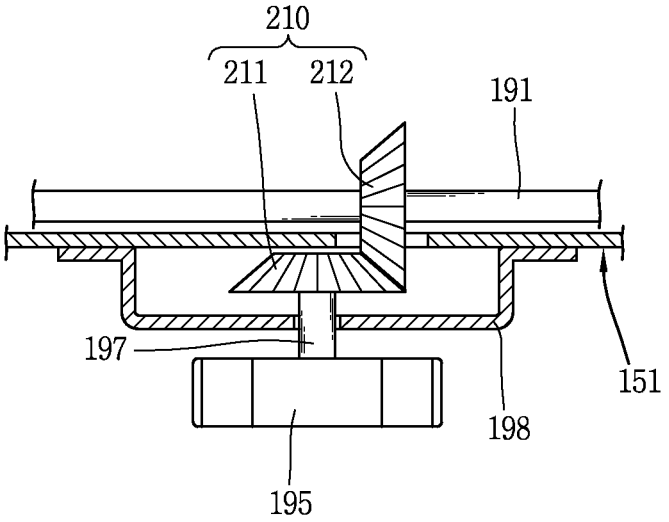
FIG. 6 is a sectional view taken along line VI-VI in FIG. 5.

In detail, as shown in FIG. 6, the power transmission gear 210 may include a first gear 211 provided on the rotational shaft 197 of the rotary handle 195 and a second gear 212 provided on the frame 151 and engaged with the first gear 211. The first gear 211 and the second gear 212 may be configured as, for example, bevel gears whose rotational shafts are perpendicular to each other. Here, preferably, the first gear 211 and the second gear 212 are configured to adjust a height of the shelf assembly 140, while rotating the rotary handle 195 by a relatively less amount.

The rotary handle 195 may be configured to have an appropriate rotation range by adjusting (or setting) a gear ratio between the first gear 211 and the second gear 212. For example, as the number of teeth of the first gear 211 is greater than that of the second gear 212, the number of rotations (rotation angle or rotation range) of the rotary handle 195 may be reduced. The range of the rotary angle of the rotary handle 195 may be appropriately adjusted.

An indication unit 220 may be provided on the panel 150 in order to indicate a rotation direction of the rotary handle 195 corresponding to ascending or descending of the protrusion 175.

As shown in FIG. 3, the indication unit 220 may be configured to include a character 221*a* (e.g., "UP" or "ascending" and "DOWN" or "descending") representing a direction for a height adjustment, a FIG. 221*b* (e.g., an arrow, or the like), or a picture (e.g., a pictogram).

Meanwhile, the power transmission unit 230 may include a first pulley 231 provided at both end portions of the shaft 191 and disposed at one side of each slider 171, a second pulley 232 disposed at the other side of the slider 171, and a belt 233 coupled to the first pulley 231 and the second pulley 232 and connected to the slider 171.

The first pulley 231 may be provided at both end portions of the shaft 191.

Namely, the first pulley 231 may be rotated together with the shaft 191 in the same direction as that of the shaft 191, when the shaft 191 is rotated.

The second pulley 232 may be disposed at one side (or a rear side of the cooling chamber 120 in a forward/backward direction) of the slider accommodation portion 155.

The second pulley 232 may be disposed such that a rotational shaft thereof is parallel to that of the first pulley 231.

The belt 233 may be coupled to the first pulley 231 and the second pulley 232 such that the belt 233 travels (or runs).

Here, regarding the first pulley 231, the second pulley 232, and the belt 233, the belt 233 may be configured as a "timing belt" including a tooth form portion (not shown) in order to prevent sliding thereof when rotated mutually.

Each belt 233 may be connected to the slider 171.

Figure 7:
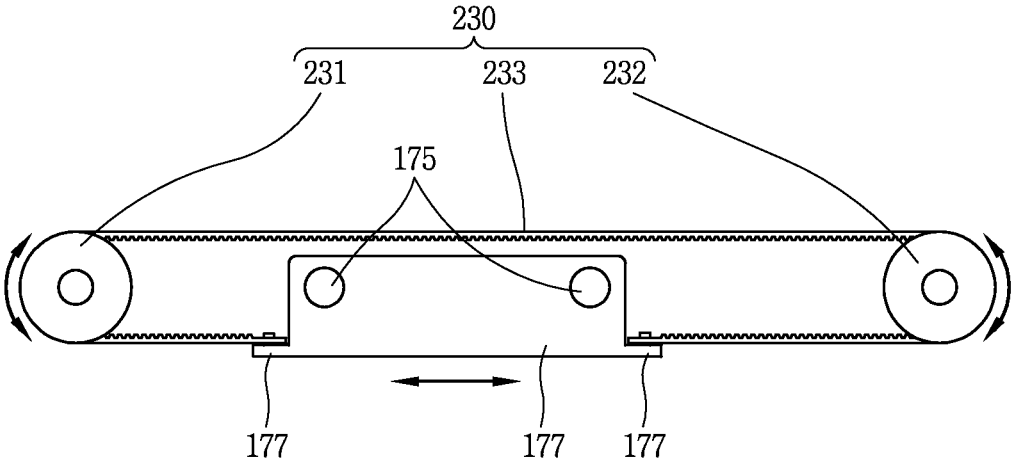
FIG. 7 is a sectional view taken along line VII-VII in FIG. 5.

For example, as shown in FIG. 7, the belt 233 may be formed to be cut so as to be connected to the slider 171. Namely, one end of the belt 233 may be connected to one side of the slider 171, and the other end of the belt 233 may be connected to the other side of the slider 171. Accordingly, the slider 171 may be moved in both directions (forwardly or backwardly) according to a running direction of the belt 233.

For example, a belt connection portion 177 may be provided on both end portions of the slider 171, so that the bent 233 may be connected thereto.

Here, the belt 233 may have a caterpillar shape and one side thereof may be connected to the slider 171.

Figure 9:
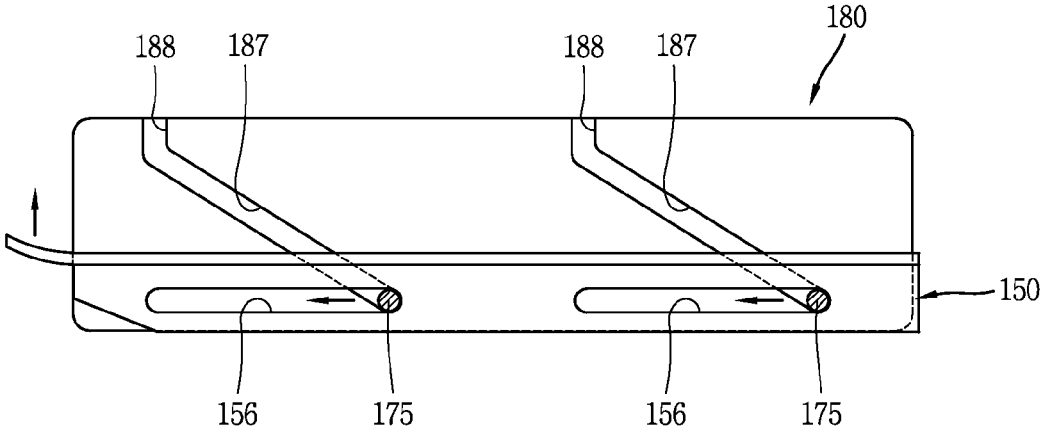
FIGS. 9 to 11 are views illustrating adjustment of a height of the shelf assembly of FIG. 2.

With such a configuration, each slider 171 may be connected to the belt 233 in a state of being accommodated within the slider accommodation portion 155. Here, as shown in FIG. 9, the slider 171 may be moved to a descending position such that each protrusion 175 is positioned at a rear end of the corresponding protrusion accommodation portion 156.

Each guide 180 may be coupled to each guide coupling portion 125 provided on both side walls of the cooling chamber 120.

When the protrusions 175 protruded from both sides of the panel 150 are disposed in the entrances 188 of the corresponding guide 180 and the panel 150 is moved downwardly, the respective protrusions 175 may be inserted into the corresponding guiding portions 187 through the corresponding entrances 188. Here, in the shelf, each protrusion 175 may be positioned at a lower end of the corresponding guide portion 187.

A food item may be received and kept on an upper surface or in a lower space of the shelf assembly 140.

Meanwhile, when a relatively tall food item is desired to be received and kept in a lower space of the shelf assembly 140, the panel 150 may be upwardly moved to adjust the height of the lower space.

When a height of the shelf assembly 140 (or a height of the lower space) is intended to be adjusted, the rotary handle 195 may be grasped and rotated according to the indication of the indication unit 220.

When the rotary handle 195 is rotated in the 'UP' direction, the panel 150 may be moved upwardly.

In detail, when the rotary handle 195 is rotated in the 'UP' direction, as shown in FIG. 6, the first gear 211 and the second gear 212 are rotated, and accordingly, the shaft 191 may be rotated. When the shaft 191 is rotated, as shown in FIG. 7, the first pulley 231 and the second pulley 232 may be rotated. Accordingly, the slider 171 may be moved to the left (or the front region of the cooling chamber 120) on the drawing. When the slider 171 starts to move from the descending position to the ascending position, the protrusion 175 may be moved from the rear end of the corresponding protrusion accommodation portion 156 to the front side. Also, each protrusion 175 may ascent from a lower end of the guiding portion 187.

Figure 10:
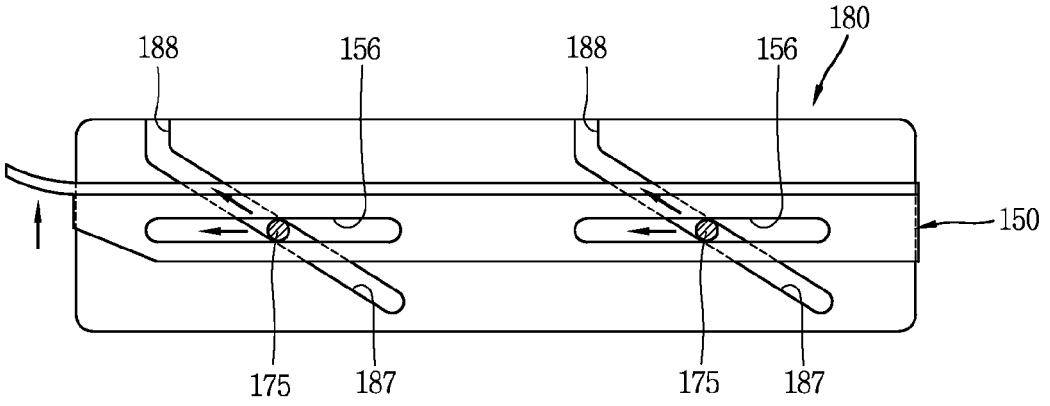

When the rotary handle 195 is rotated by about a half of the entire rotation angle, as shown in FIG. 10, the protrusion 175 may be positioned in a middle portion of the protrusion accommodation portion 156 and the guiding portion 187. Thus, by appropriately adjusting the rotation degree (angle) of the rotary handle 195, an increase and decrease of the height of the shelf assembly 140 in the lower space can be appropriately adjusted.

Figure 11:
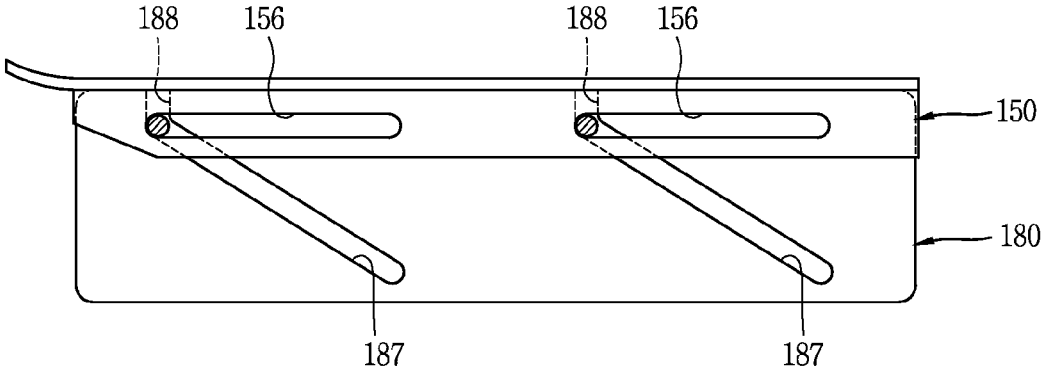
Figure 12:
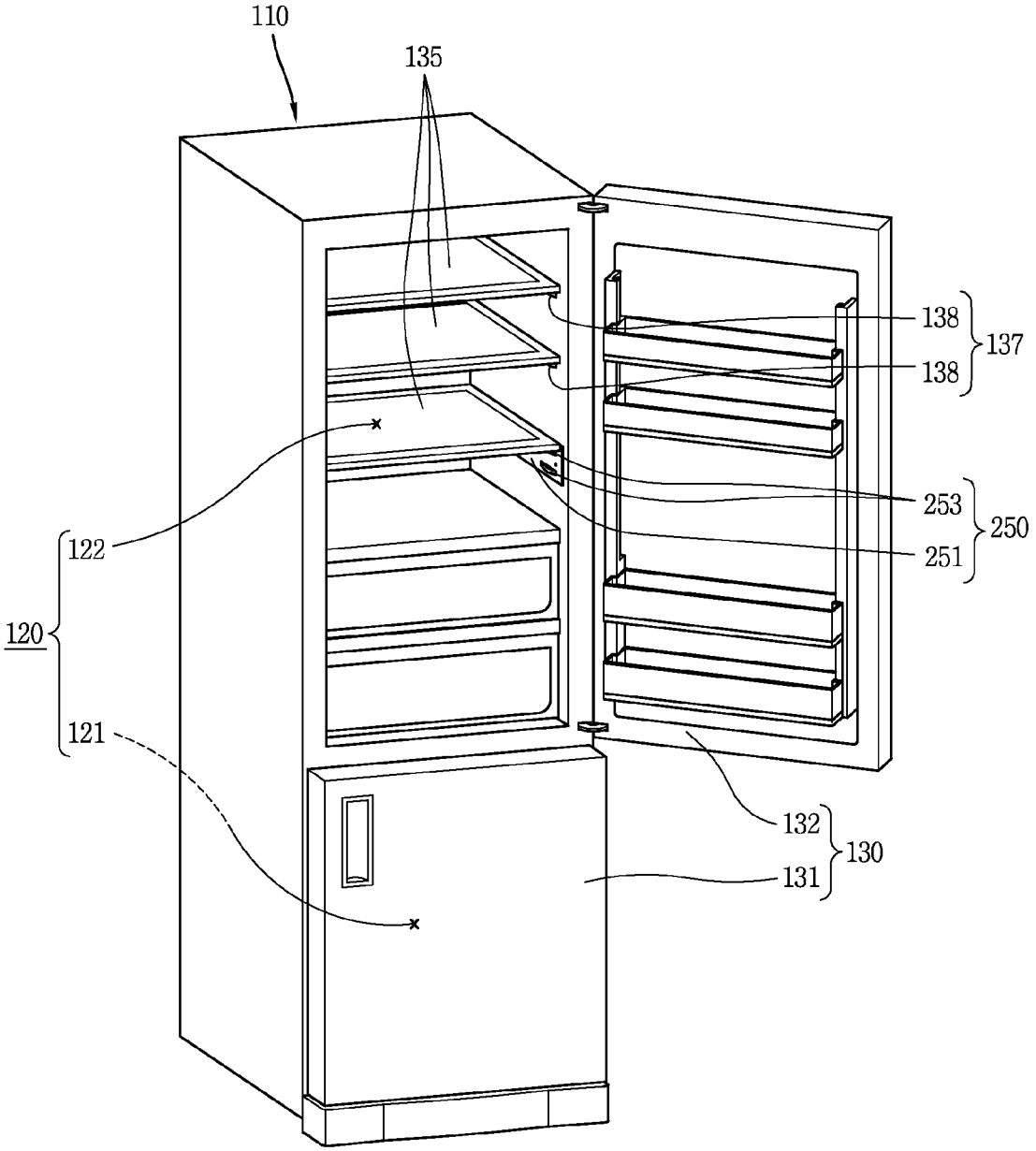
FIG. 12 is a view illustrating a modification of the guide of the refrigerator in FIG. 2.

When the rotary handle 195 is rotated to the maximum, as shown in FIG. 11, the protrusion 175 may be positioned in a front end portion of the protrusion accommodation portion 156 and at an upper end of the guiding portion 187. At this time, the panel 150 may be positioned at an ascending position.

Since the height-adjustable shelf assembly 140 according to an embodiment of the present invention is configured to include the shaft 191, the power transmission unit 230, and the rotary handle 195, a height of the shelf can be promptly adjusted by simply rotating the rotary handle 195.

Also, since the power transmission gear 210 is disposed between the shaft 191 and the rotary handle 195, designing of a width of the rotation angle of the rotary handle 195 can be facilitated. Namely, by adjusting a configuration of a gear ratio of the power transmission gear 210, a range of the rotation angle of the rotary handle 195 can be variously designed.

Also, since the rotary handle 195 is disposed on a bottom portion of the panel 150, interference that may be caused when the rotary handle 195 is used can be restrained.

Meanwhile, the refrigerator according to the present invention may include a shelf support member 250 disposed in the guide coupling portion 125 to support the shelf 135, in case that the guide 180 is separated. Accordingly, when the height-adjustable shelf assembly 140 is not used or when the height-adjustable shelf assembly 140 cannot be used, the shelf 135 may be installed by using the shelf support member 250 to receive or keep a food item on the shelf 135, thus enhancing keeping efficiency of the cooling chamber 120.

For example, the shelf support member 250 may include a rectangular body 251 and support protrusions 253 formed to be protruded from the body 251. The body 251 may be configured to have a shape and size corresponding to the guide main body 181.

The body 251 may include a fastening member coupling hole 183 formed in a penetrative manner to allow the fastening member 184 to be coupled therethrough.

The cap 185 may be provided on the body 251 and coupled to the fastening member coupling hole 183.

The support protrusion 253 may be provided on one wide flat surface (or an inner surface) of the body 251 in order to supply the shelf (a plain shelf or a general shelf) 135.

A plurality of support protrusions 253 may be provided.

For example, a plurality of support protrusions 253 may be spaced apart from each other in a length direction. Here, the support protrusions 253 may have the same height from a lower end in order to simultaneously support the same shelf 135 cooperatively.

Figure 13:
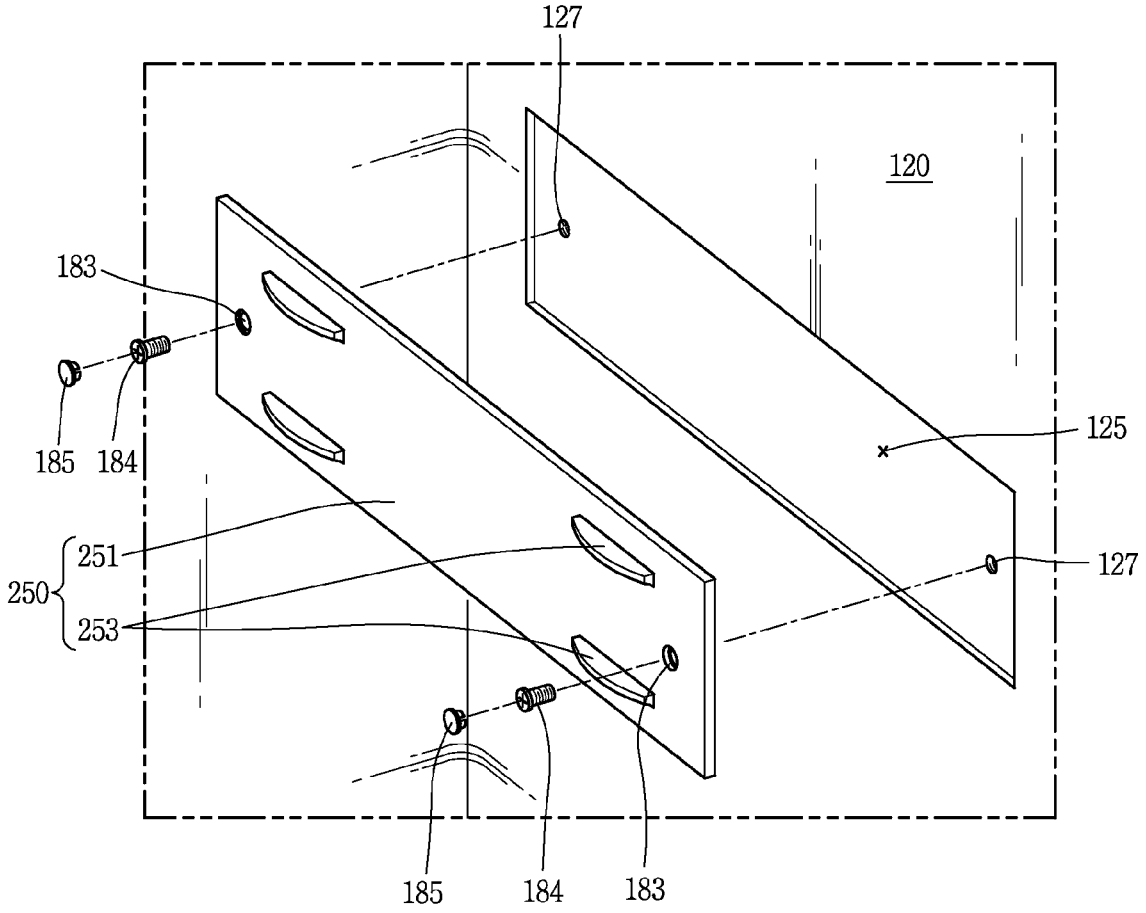
FIG. 13 is a front view of the guide of FIG. 12.

Also, as shown in FIG. 13, the plurality of protrusions 253 may be formed to be spaced apart in a vertical direction. Accordingly, the shelf 135 may be selectively supported by the lower support protrusions 253 or the upper support protrusions 253. Also, the shelf 135 may be simultaneously supported by lower support protrusions 253 and upper support protrusions 253.

With such a configuration, when the shelf assembly 140 is not used, the guide 180 is separated from the wall surface of the cooling chamber 120 and the shelf support member 250 may be coupled to the guide coupling portion 125.

When the shelf 135 is supported by using the support protrusion 253 of the shelf support member 250, food items may be received and kept in upper and lower sides of the shelf 135, respectively.

Another embodiment of the present invention will be described with reference to FIGS. 14 through 16.

Illustration of the same or equivalent components as or to the foregoing and illustrated components may be omitted for the convenience of description of the drawings, and may be described by using the same reference numerals. Also, a repeated description of some components may be omitted.

A refrigerator having a height-adjustable shelf assembly according to the present embodiment includes a refrigerator main body 110 having a cooling chamber 120, a cooling chamber door 130 for opening and closing the cooling chamber 120, and a height adjustable shelf assembly 240 provided within the cooling chamber 120 according to an embodiment of the present invention.

The shelf assembly 240 may include the panel 150, the protrusions 175 provided on both sides of the panel 150 such that they are relatively movable forwardly and backwardly with respect to the panel 150, the guide 180 for guiding the protrusions 175 such that they ascend and descend, and the height adjusting unit 190 for moving the protrusions 175 forwardly and backwardly with respect to the panel 150 to adjust a height of the panel 150.

The guide 180 may be provided in the guide coupling portions 125 provided on both side walls of the cooling chamber 120.

Each guide 180 may include the guiding portion 187 for guiding ascending and descending of the protrusion 175.

The panel 150 may include the cover 161, the frame 151 supporting the cover 161, and the slider 171 slidably moving forwardly and backwardly on both sides of the frame 151.

The slider 171 may be configured to be movable on both sides of the frame 151 in a forward/backward direction.

The protrusion 175 may be provided on one lateral surface (or an outer surface) of the slider 171.

The protrusions 175 may be spaced apart on the lateral surface of the slider 171 in a length direction.

Figure 14:
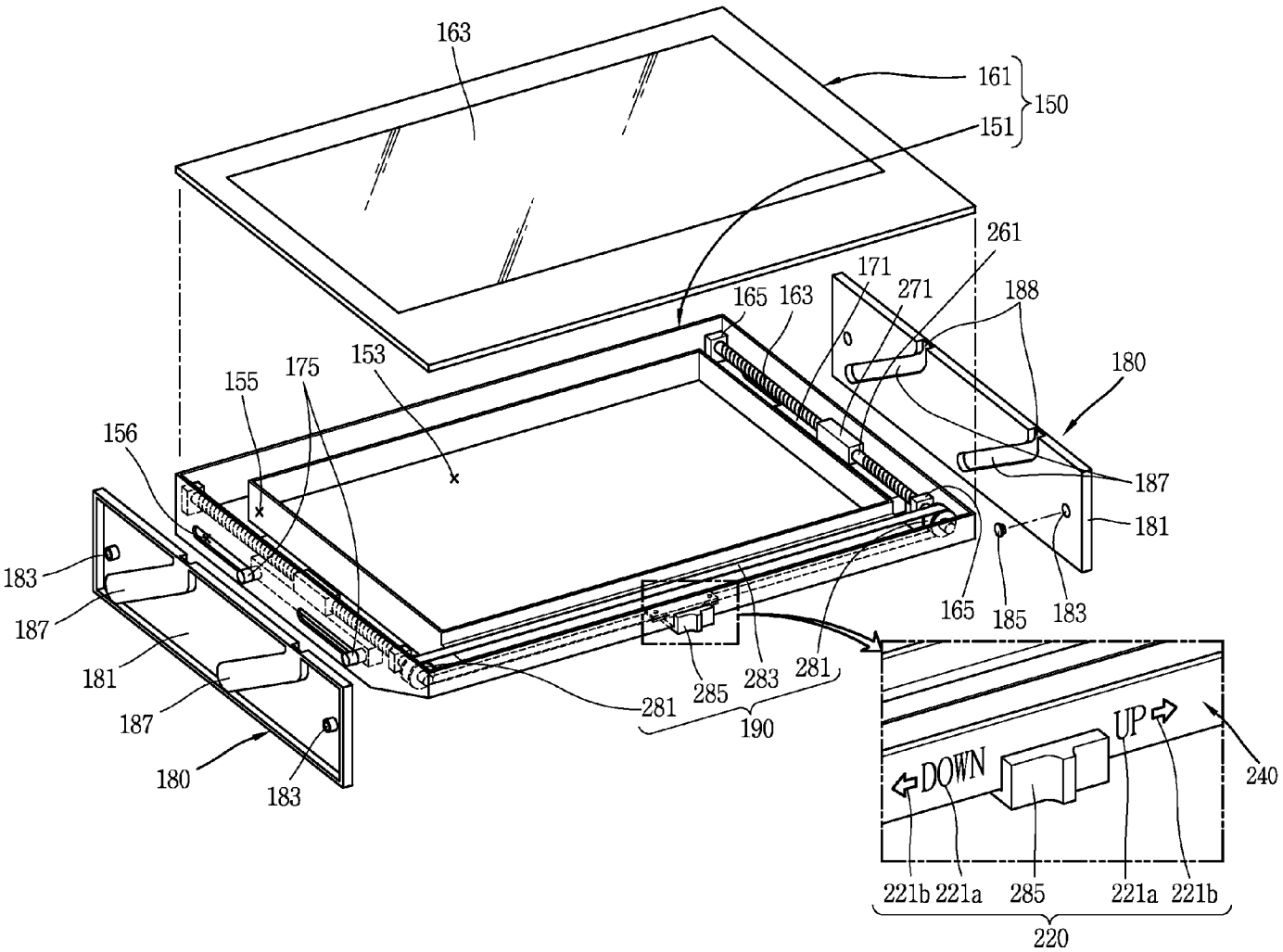
FIG. 14 is an exploded perspective view of a height-adjustable shelf assembly according to another embodiment of the present invention.
Figure 15:
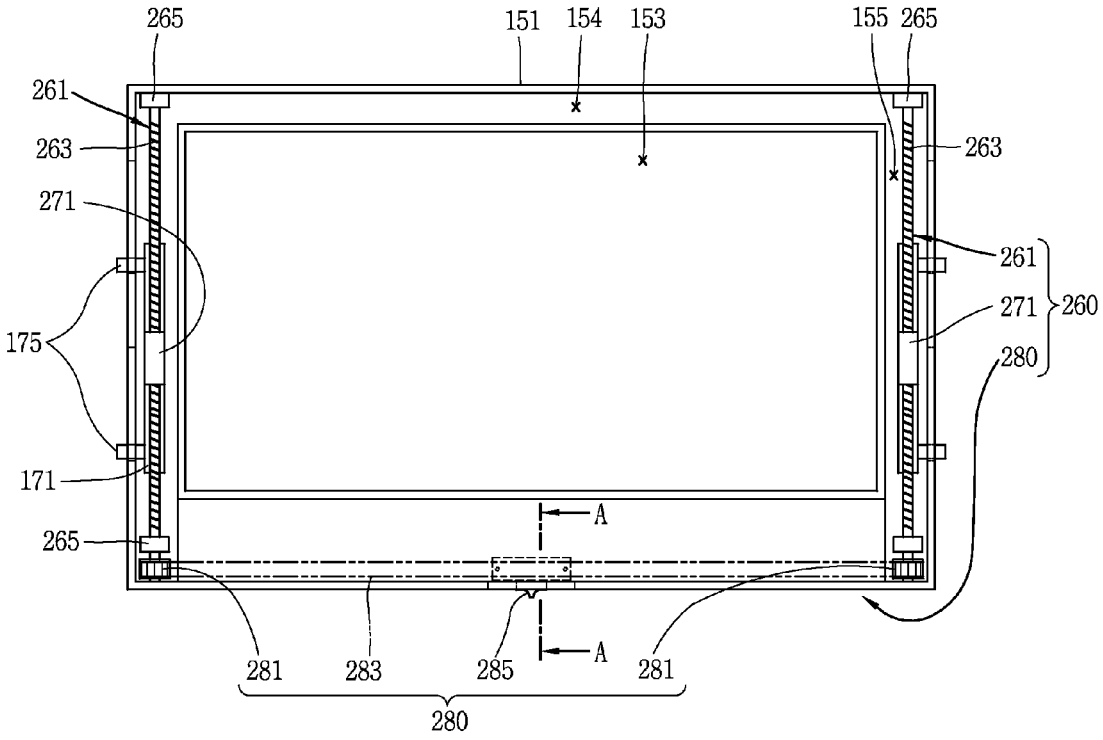
FIG. 15 is a plan view of FIG. 11.
Figure 16:
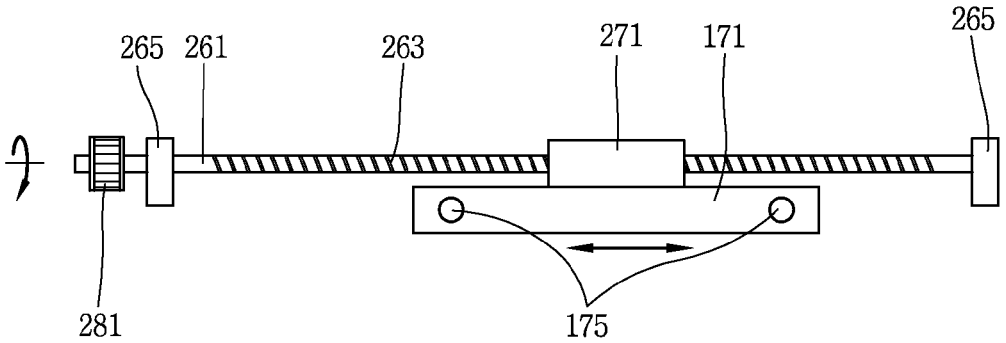
FIG. 16 is a side sectional view of a slider region of FIG. 14.

Meanwhile, as shown in FIGS. 14 through 16, the height adjusting unit 260 may include a lead screw 261 disposed in a movement direction of each slider 171, a female screw unit 271 screw-coupled with the lead screw 261 and provided in the slider 171, and a lead screw driving unit 280 for rotating the lead screw 261.

The lead screw 261 may be disposed in a movement direction of the slider 171.

A male screw unit 263 may be formed on an outer surface of the lead screw 261.

The lead screw 261 may be rotatably supported.

For example, a support piece 265 rotatably supporting the lead screw 261 may be provided in both end portions of the lead screw 261.

The female screw unit 271 may be provided on one side of the slider 171. The female screw unit 271 may be screw-coupled to the male screw unit 263 and moved relatively.

When the lead screw 261 and the female screw unit 271 are rotated in a clockwise direction on the drawing, the female screw unit 271 may be moved forwardly, and when the lead screw 261 and the female screw unit 271 are rotated in a counterclockwise direction, the female screw unit 271 may be moved backwardly.

In the present embodiment, a case in which the female screw unit 271 is provided on an upper portion of the slider 171 is illustrated, but an installation opposition of the female screw unit 271 may be appropriately adjusted. For example, the lead screw 261 may be installed to penetrate the slider 171, and the female screw unit 271 may be provided in a region within the slider 171 or in a front or rear region of the slider 171.

Meanwhile, the lead screw driving unit 280 may include a pulley 281 provided in each lead screw 261, a belt 283 coupled to the pulley 281, and a handle 285 connected to the belt 283 to rotate the belt 283.

The pulley 281 may be provided in each lead screw 261.

In detail, the pulley 281 may be provided on a front end portion of each lead screw 261.

The belt 283 may be coupled to the pulley 281 provided on a front end portion of each lead screw 261 such that the belt 283 is rotatable (or may be able to run). Here, the pulley 281 and the belt 283 may be configured as so-called timing belts having a tooth form portion.

The handle 285 may be connected to the belt 283 to drive the belt 283.

The handle 285 may be provided in a front region of the panel 150.

The handle 285 may be configured to be slidably movable along a front is edge (or rim) portion (or a longer side portion). Accordingly, the belt 283 may be moved (or rotated) when the handle 285 is moved.

Figure 17:
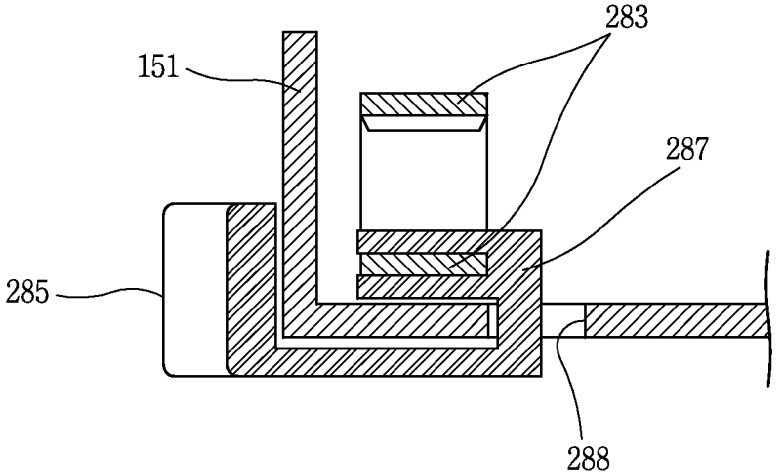
FIG. 17 is a sectional view taken along line A-A in FIG. 15.

As shown in FIG. 17, the handle 285 may include an attachment or a connection member 287 (referred to as a 'connection member 287', hereinafter) connected to the belt 283. Accordingly, when the handle 285 is moved, the belt 283 may be interwork to be rotated (or run).

An insertion hole may be formed to penetrate the frame 151 to allow the connection member 287 to be inserted therein.

The insertion hole 288 may be formed to correspond to a movement path of the connection member 287.

The panel 150 may include the indication unit 220 indicating a manipulation (movement) direction of the handle 285 according to an ascending direction of the protrusion 175.

In detail, the indication unit 220 may include the character 221*a* and the figure 221*b* indicating a direction for adjusting a height. For example, the character 221*a* may include any one of "UP", "ascending", or "upwardly" indicating ascending of the panel 150 and any one of "DOWN", "descending", or "downwardly" indicating descending of the panel 150. The figure 221*b* may be configured as, for example, an arrow indicating a particular direction.

With such a configuration, when a height of the shelf assembly 240 is desired to be adjusted, the handle 285 may be moved in a desired direction (to the left or right).

For example, when a height of the panel 150 of the shelf assembly 240 is intended to rise, the handle 285 may be moved in a direction, i.e., in the rightward direction, indicated on the indication unit 220.

When the handle 285 is moved to the right, the belt 283 may run (or may be rotated) to the right. When the belt 283 is rotated to the right, as shown in FIG. 15, the pulley 281 may be rotated in a clockwise direction. Accordingly, each lead screw 261 may be rotated in a clockwise direction and each slider 171 may be moved to a front region of the panel 150.

When the slider 171 is moved in a front side, each protrusion 175 may be lifted along the guiding unit 187. Accordingly, the panel 150 may be upwardly moved. Here, since the protrusion 175 is lifted in proportion to a movement of the handle 285, a height of the panel 150 may be appropriately adjusted by appropriately adjusting a degree of movement of the handle 285.

Meanwhile, when the handle 285 is moved in a leftward direction on the drawing, the belt 283 may be rotated in a counterclockwise direction. Accordingly, each lead screw 261 is rotated in a counterclockwise direction and each slider 171 may be moved to a rear region of the panel 150. Accordingly, each protrusion 175 may descends along the guiding unit 187 and the panel 150 may be moved to a lower side.

Since the height-adjustable shelf assembly 240 according to the present embodiment includes the height adjusting unit 260, the lead screw 261, the female screw unit 271, and the lead screw driving unit 280, and the lead screw driving unit 280 includes the pulley 281, the belt 283, and the handle 285, a height of the panel 150 can be adjusted with relatively weak force (manipulation force).

Also, since the handle 285 is configured to be moved along the longer side portion of the panel 150, a manipulation range of the handle 285 can be increased, and thus, a height of the panel 150 can be easily adjusted and minutely adjusted.

Another embodiment of the present invention will be described in detail with reference to FIGS. 18 through 24.

Figure 18:
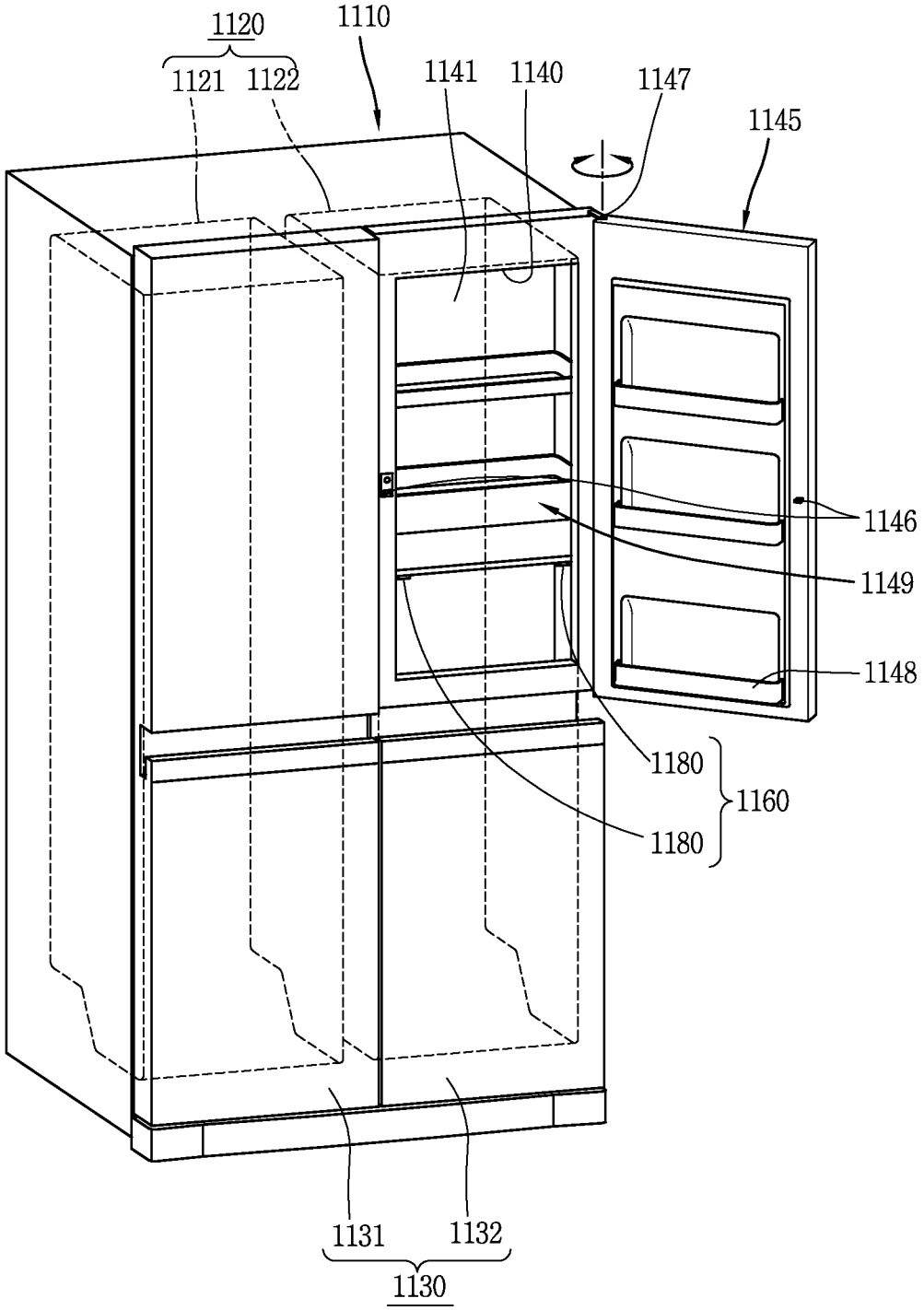
FIG. 18 is a perspective view of a refrigerator according to an embodiment of the present invention.
Figure 19:
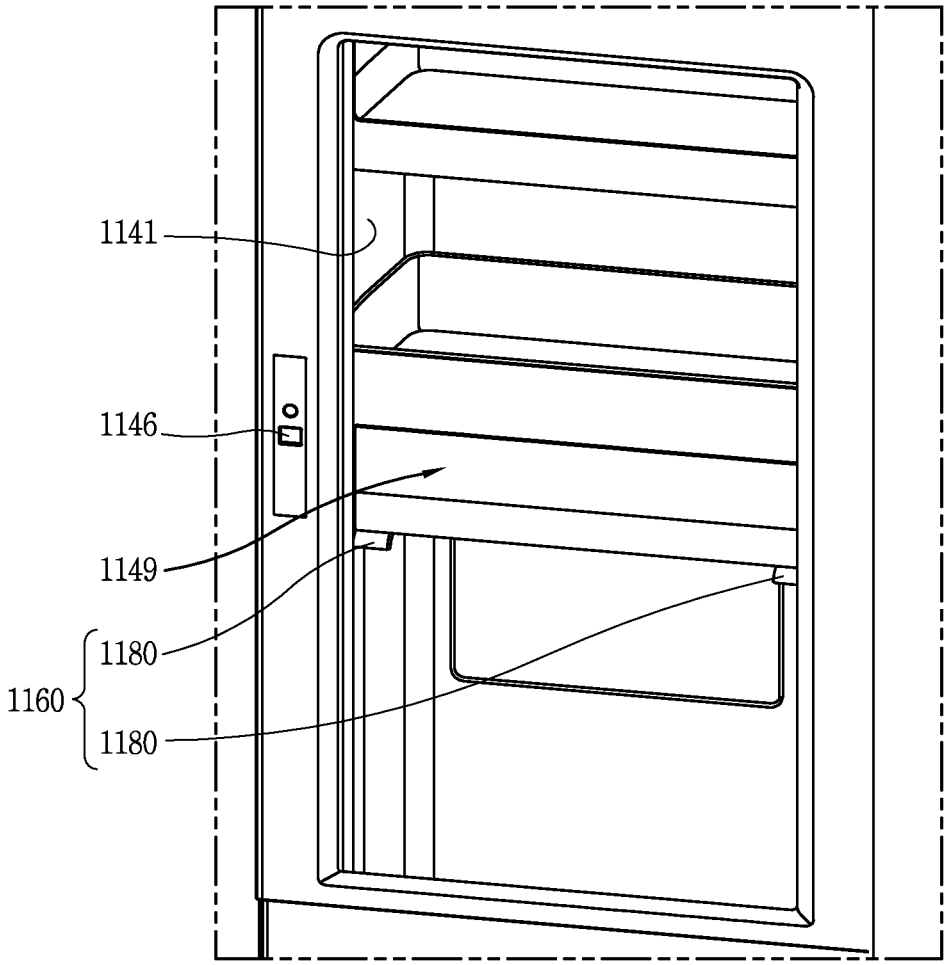
FIG. 19 is an enlarged view of a major part of FIG. 18.
Figure 20:
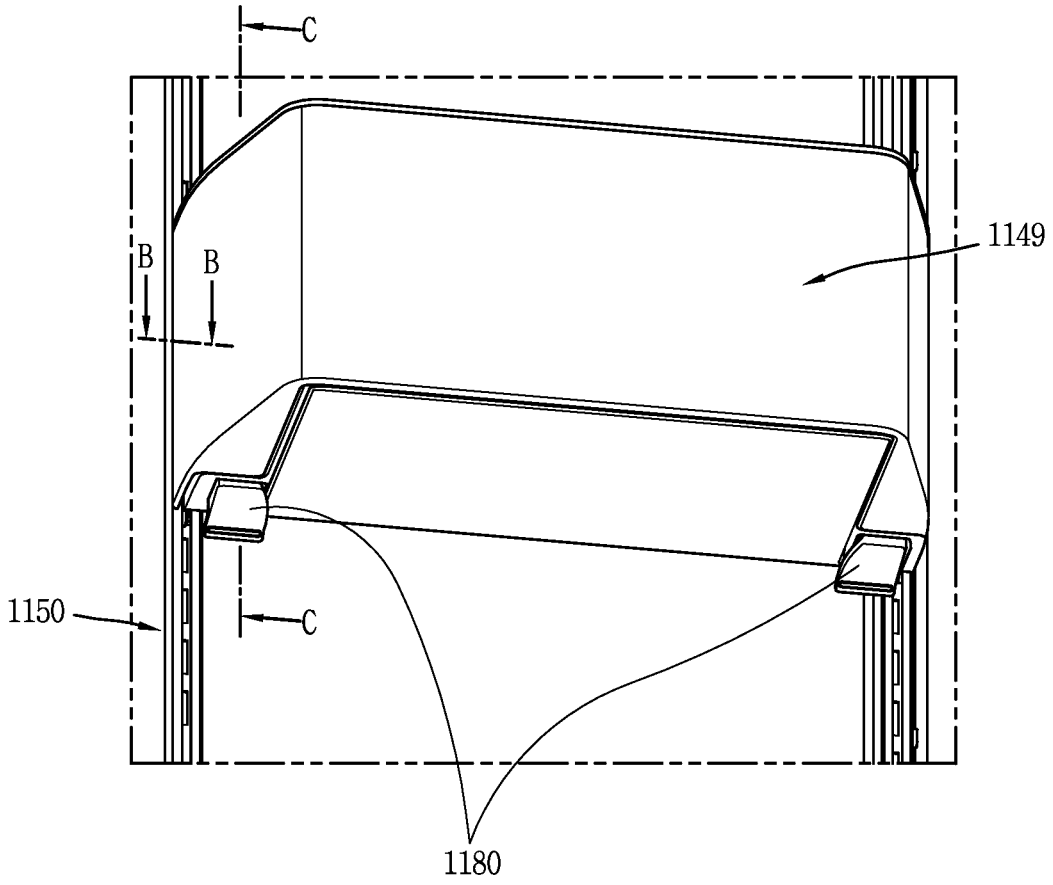
FIG. 20 is a view illustrating a coupled state of a basket and a rail in FIG. 19.

As shown in FIG. 18, a refrigerator according to an embodiment of the present invention may include a refrigerator main body 1110 having a cooling chamber 1120, a cooling chamber door 1130 for opening and closing the cooling chamber 1120, a basket 1149 provided in the cooling chamber door 1130 such that it ascends and descends, and a height adjusting unit 1160 for adjusting a height of ascending or descending of the basket 1149. Here, the cooling chamber 1120 may generally refer to a freezing chamber 1121 and a refrigerating chamber 1122, and the refrigerator main body 1110 may include any one of the freezing chamber 1121 and the refrigerating chamber 1122.

A plurality of cooling chamber 1120 may be provided within the refrigerator main body 1110.

The cooling chamber 1120 may include the freezing chamber 1121 and the refrigerating chamber 1122.

The cooling chamber door 1130 may include a freezing chamber door 1131 and a refrigerating chamber door 1132 for opening and closing the refrigerating chamber 1122.

Meanwhile, the refrigerating chamber door 1132 may include an opening 1140 such that the interior and the exterior of the refrigerator communicate with each other. Accordingly, an article or a food item may be received and/or taken out through the opening 1140 without opening the refrigerating chamber door 1132.

A door 1145 may be provided at one side of the opening 1140 to open and close the opening 1140.

The door 1145 may be configured to rotate on a rotational shaft 1147 is disposed in a vertical direction of the refrigerating chamber door 1132. Thus, although the size of the door 1145 is increased, the door 1145 can be easily opened and closed with relatively weak force.

The door 114 may include a door basket 1148.

A housing 1141 forming a certain storage space may be provided within the opening 1140. Thus, a leakage of cold air from the refrigerating chamber 1122 can be restrained when the door 1145 is open.

Meanwhile, a basket 1149 may be provided within the opening 1140.

The basket 1149 may be configured to have, for example, an upwardly open container-like shape.

The basket 114 may be configured to ascend and descend in a vertical direction.

A rail 1150 may be disposed in the ascending and descending direction of the basket 1149 on the refrigerating chamber door 1132 in order to guide the basket 1149.

The rails 1150 may be separately disposed on both sides of the basket 1149.

Each rail 1150 may be provided on both side walls of the opening 1140.

The rail 1150 may have a length greater than a width thereof.

Figure 21:
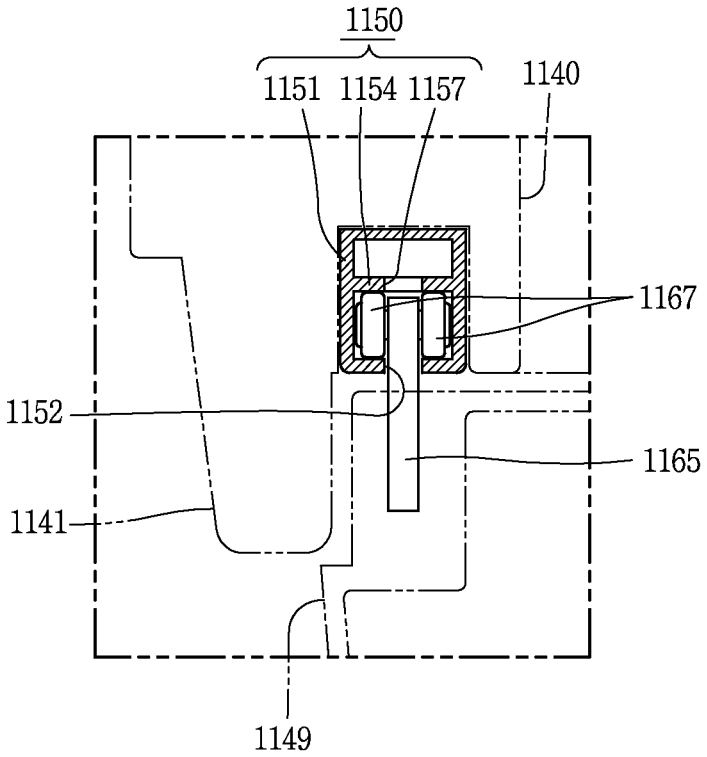
FIG. 21 is a sectional view taken along line B-B in FIG. 20.

In detail, as shown in FIG. 21, the rail 1150 may include an annular body 1151 having a slit 1152 provided on one side thereof.

The body 1151 may have a substantially rectangular shape.

Each rail 1150 may be disposed such that the corresponding slit 1152 faces the refrigerating chamber 1122.

A partition 1154 may be provided within the rain 1150 in order to partition an internal space of the body 1151. The partition 1154 may extend in a length direction of thee body 1151.

Figure 22:
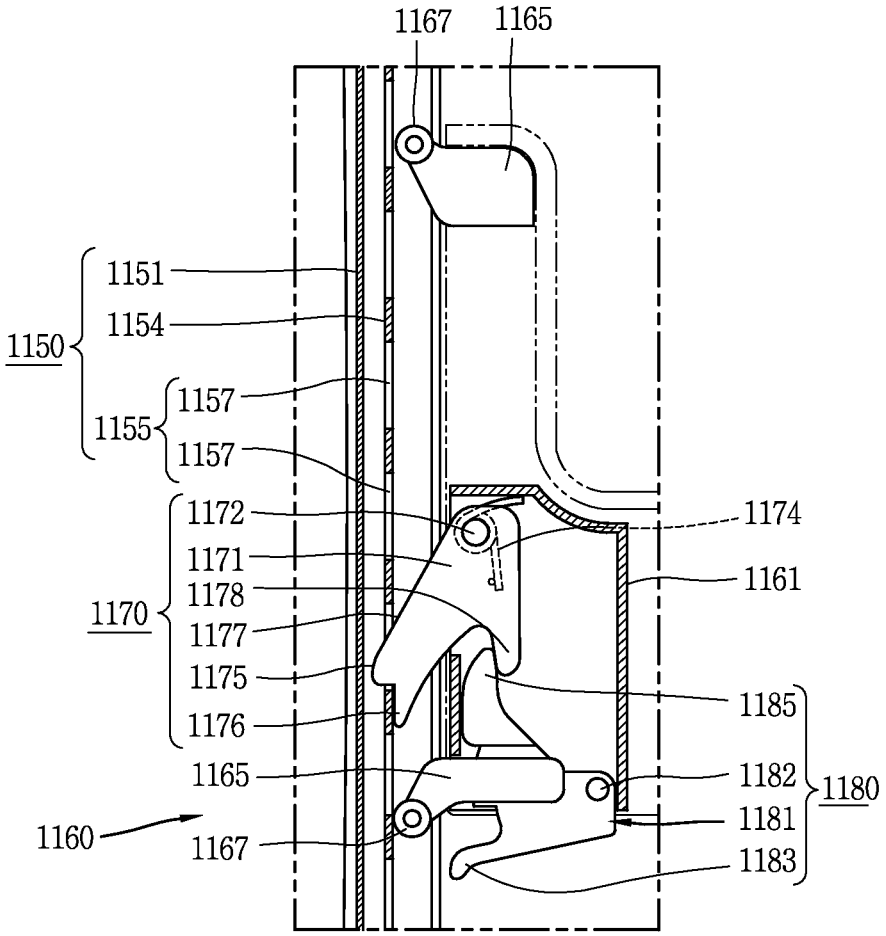
FIG. 22 is a sectional view taken along line C-C in FIG. 20.

The partition 1154 may include a stop portion 1155 that may be engaged with a latch 1170 of the height adjusting unit 1160 as described hereinafter at a pre-set interval For example, as shown in FIG. 22, the stop portion 1155 may include a stop recess 1157 formed to penetrate a wide flat surface thereof. Here, the stop portion 1155 may include a tooth form portion (not shown) engaged with a stop protrusion 1175 of a latch 1170 as described hereinafter in a vertical direction. For example, the stop portion 1155 may be configured such that an upper surface is a horizontal surface and a bottom surface thereof is downwardly sloped inwardly.

The basket 1149 may include a support portion 1165 having one side inserted in the rail 1150 to movably support the basket 1149.

The support portion 1165 may be moved up and down along the slit 1152.

The end portion, of the support portion 1165, inserted into the rail 1150 may have a roller 1167 which is in contact with an inner wall surface of the rail 1150 and rotatable. Accordingly, the basket 1149 can smoothly ascend and descend.

A plurality of support portions 1165 may be provided. For example, as shown in FIG. 22, the support portions 1165 may be provided on upper and lower portions of the basket 1149. Accordingly, the basket 1149 may be stably supported with respect to the rail 1150.

Meanwhile, the height adjusting unit 1160 may include a latch 1170 which may be rotatable between an engagement position at which the height adjusting unit 1160 is engaged with the stop portion 1155 in a vertical direction and a release position at which an engaged state of the height adjusting unit 1160 is released, and a manipulation lever 1180 provided at one side of the latch 1170 and releasing an engaged state of the latch 1170 when pressed.

The height adjusting unit 1160 may include a case 1161 forming an accommodation space therein.

The latch 1170 and the manipulation lever 1180 may be rotatably installed within the case 1161.

The case 1161 may be coupled to the basket 1149. Here, the latch 1170 and the manipulation lever 1180 may be configured to be directly coupled to the basket 1149, rather than being coupled to the case 1161.

The latch 1170 may include a latch main body 1171, having a rotational shaft 1172 and a stop protrusion 1175 inserted into a stop recess 1157 at one side of the latch main body 1171.

A sloped portion 1177 may be formed on an upper side of the stop protrusion 1175 such that it is upwardly sloped toward the rotational shaft 1172. Thus, when the latch 1170 ascends, the stop protrusion 1175 is separated from the stop recess 1157, so the latch 1170 can freely ascend without being restrained.

A stopper 1176 may be formed on a lower side of the stop protrusion 1175 in order to limit a depth of the stop protrusion 1175 when the stop protrusion 1175 is inserted into the stop recess 1157. Thus, the stop protrusion 1175 can be prevented from being excessively inserted into the stop recess 1157 and restrained. The stopper 1176 may be configured to be protruded horizontally in an insertion direction of the stop protrusion 1175.

An elastic member 1174 may be provided on one side of the latch 1170 in order to provide elastic force to make the stop protrusion 1175 inserted into the stop recess 1157. Accordingly, when the basket 1149 descends, the stop protrusion 1175 can be promptly inserted into the stop recess 1157 so as to be engaged, thus preventing the basket 1149 from falling continuously. The elastic member 1174 may be configured as a torsion spring coupled to the rotational shaft 1172 of the latch 1170.

The latch main body 1171 may include an operating portion 1178 in contact with the manipulation lever 1180.

The operating portion 1178 may be configured to extend in a downward direction of the rotational shaft 1172.

The manipulation lever 1180 may be provided in one side of the latch 1170 in order to rotate the latch 1170 to a release position. In detail, the manipulation lever 11870 may be disposed at a lower side of the latch 1170.

The manipulation lever 1180 may include a manipulation lever main body 1181 including a rotational shaft 1182.

The manipulation lever main body 1181 may include a handle portion 1183 that can be manipulated to be pressed and a driving arm 1185 spaced apart from the handle portion 1183 and extending toward the operating portion 1178.

Figure 23:
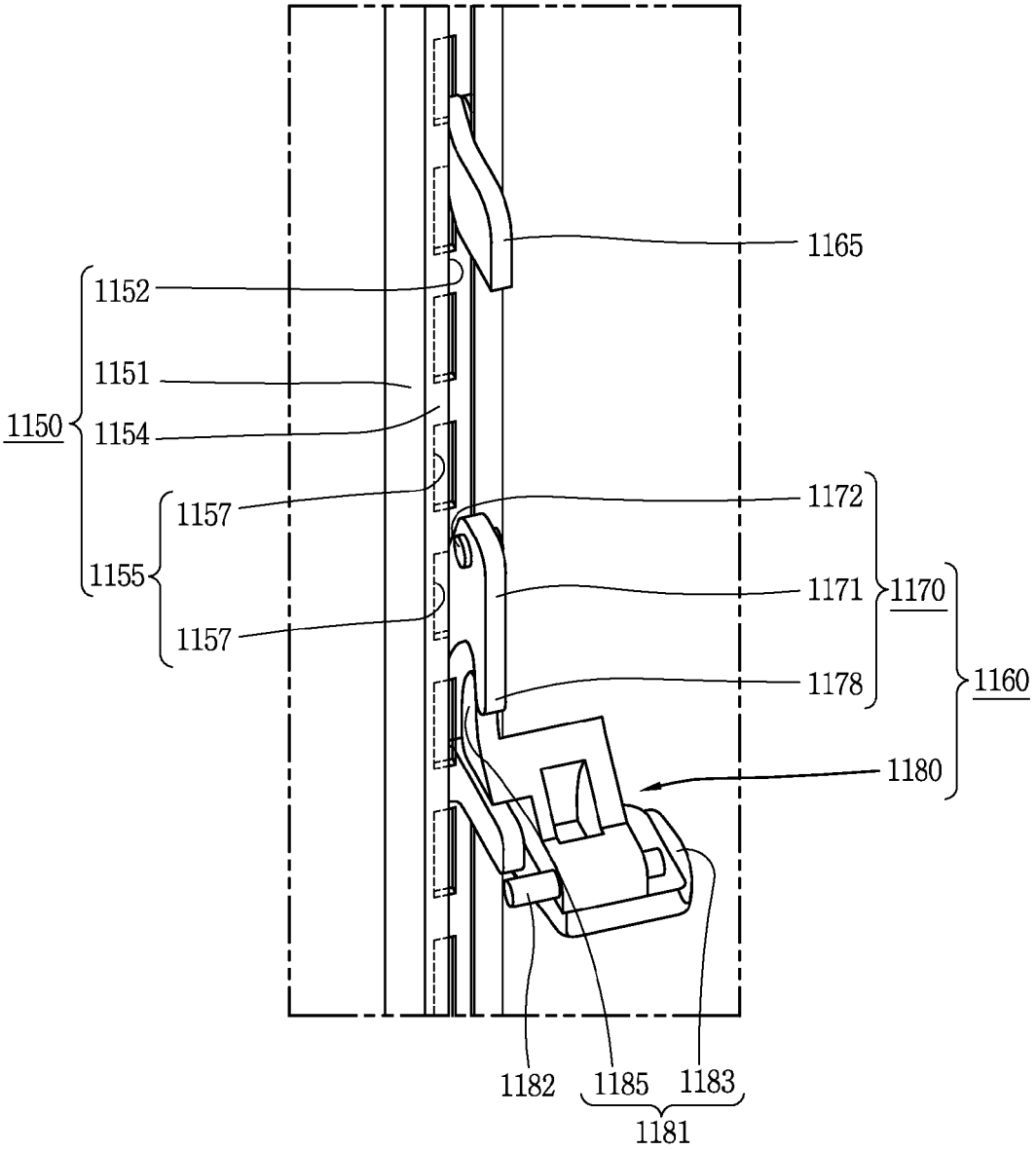
FIG. 23 is a perspective view of a coupled state of a latch and a manipulation lever in FIG. 22.

Here, as shown in FIG. 23, the center of the manipulation lever main body 1181 may be spaced apart from the center of the rail 1150.

The driving arm 11885 may be formed to be bent toward the latch 1170 from the center of the latch main body 1171 such that the center thereof is disposed at the center of the rail 1150 or the latch 1170.

The handle portion 1183 may be disposed at a lower side of the basket 1149. In detail, the handle portion 1183 may be disposed to be spaced apart from a bottom portion of the basket 1149. Accordingly, the handle portion 1183 may be pressed upwardly to facilitate a pressing manipulation.

With such a configuration, when the basket 1149 is intended to be lifted, the bottom portion of the basket 1149 is upwardly pressed and when the pressing is stopped at a desired position, adjustment of ascending position of the basket 1149 may be completed. In detail, when the basket 1149 is upwardly pressed, the sloped portion 1177 of the latch 1170 is brought into contact with an upper edge portion and the latch 1170 may be pressed and rotated on the rotational shaft 1172. Accordingly, the stop protrusion 1175 may be separated from the stop recess 1157, and the latch 1170 may ascend.

When the latch 1170 ascends, the latch 1170 may be rotated toward the stop recess 1157 by elastic force of the elastic member 1174. Also, as the latch 1170 ascends, it is pressed again so the stop protrusion 1175 is separated from the stop recess 1157. This process may be repeated. Thus, the basket 1149 may continuously ascend by a desired height. When the basket 1149 is placed at a desired position, the latch 1170 is promptly rotated to an engagement position by the elastic force of the elastic member 1174, and as the stop protrusion 1175 is inserted into the stop recess 1157, the basket 1149 may be fixed to a corresponding position.

Meanwhile, when the basket 1149 is intended to be lowered, in a state in which the handle portion 1183 of the manipulation lever 1180 is upwardly pressed, the basket 1149 may be lowered to a desired position (or height).

Figure 24:
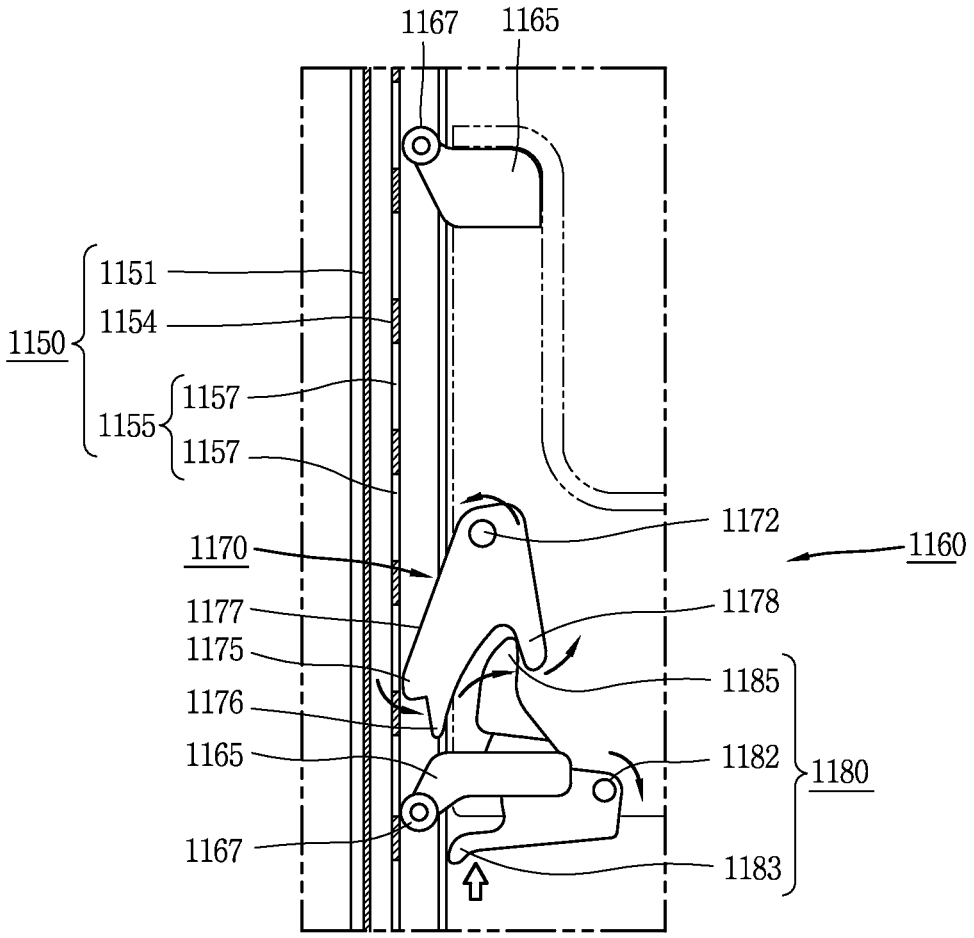
FIG. 24 is a view illustrating an operation of the manipulation lever and the latch in FIG. 22.

When the handle portion 1183 is pressed, as shown in FIG. 24, the manipulation lever main body 1181 may rotate on the rotational shaft 1182. When the manipulation lever main body 1181 rotates, the driving arm 1185 is rotated, the operating portion 1178 in contact with the driving arm 1185 is pressed, and the latch 1170 may be rotated to a release position. Accordingly, the stop protrusion 1175 may be separated from the stop recess 1157, and thus, the engagement thereof can be released. Accordingly, the basket 1149 can be freely lowered without being restrained.

When the basket 1149 is lowered to a desired position, pressing of the handle portion 1183 may be released. When pressurization force of the handle portion 1183 is removed, the latch 1170 may be rotated to the engagement position by elastic force thereof. Accordingly, the stop protrusion 1175 may be inserted into the stop recess 1157 and the basket 1149 may be fixed to a corresponding position. Meanwhile, when the latch 1170 is rotated to the engagement position, the driving arm 1185 is pressed by the operating portion 1178 so the manipulation lever 1180 may be returned to its initial position.

Another embodiment of the present invention will be described with reference to FIGS. 25 to 28.

The same reference numerals will be used for the same or equivalent components as or to the foregoing and illustrated components for the convenience of description of drawings and a detailed description of some repeated components may be omitted.

Figure 25:
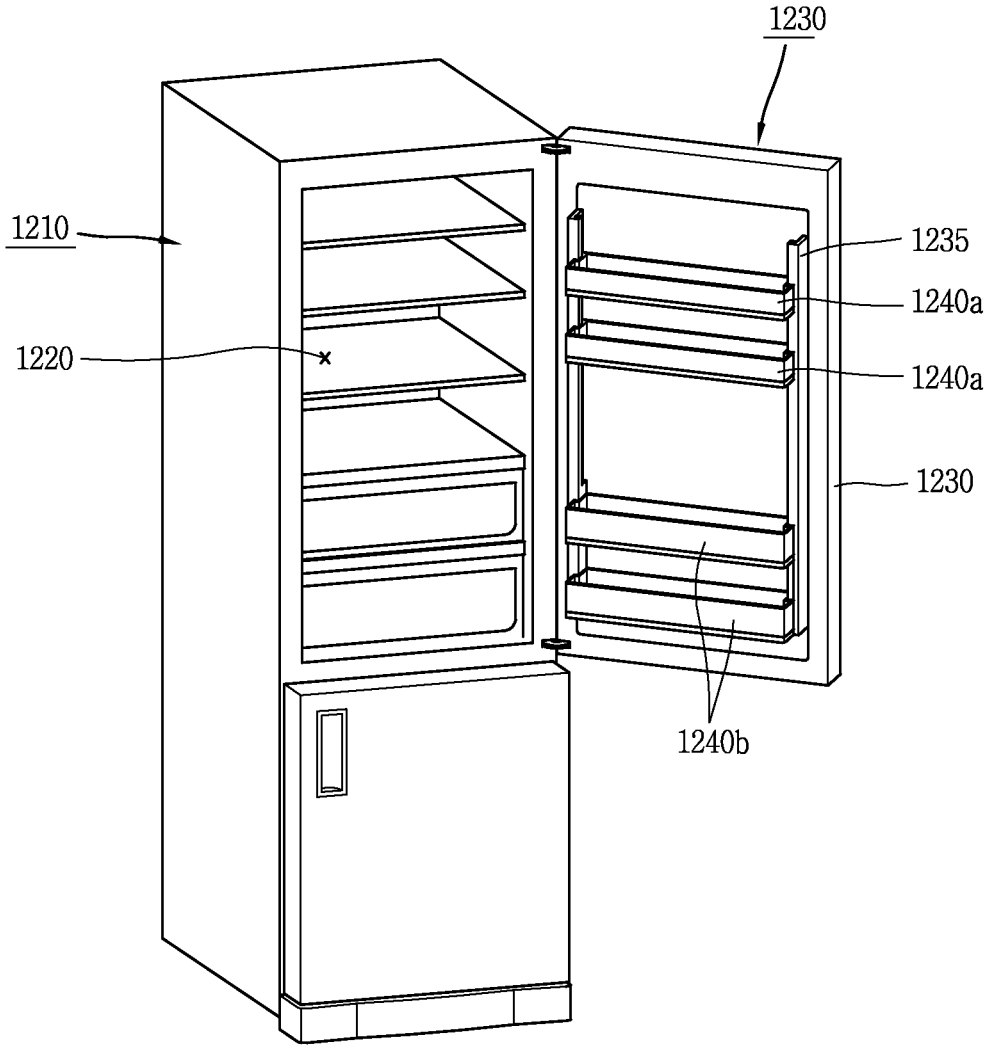
FIG. 25 is a perspective view of a refrigerator according to another embodiment of the present invention.
Figure 26:
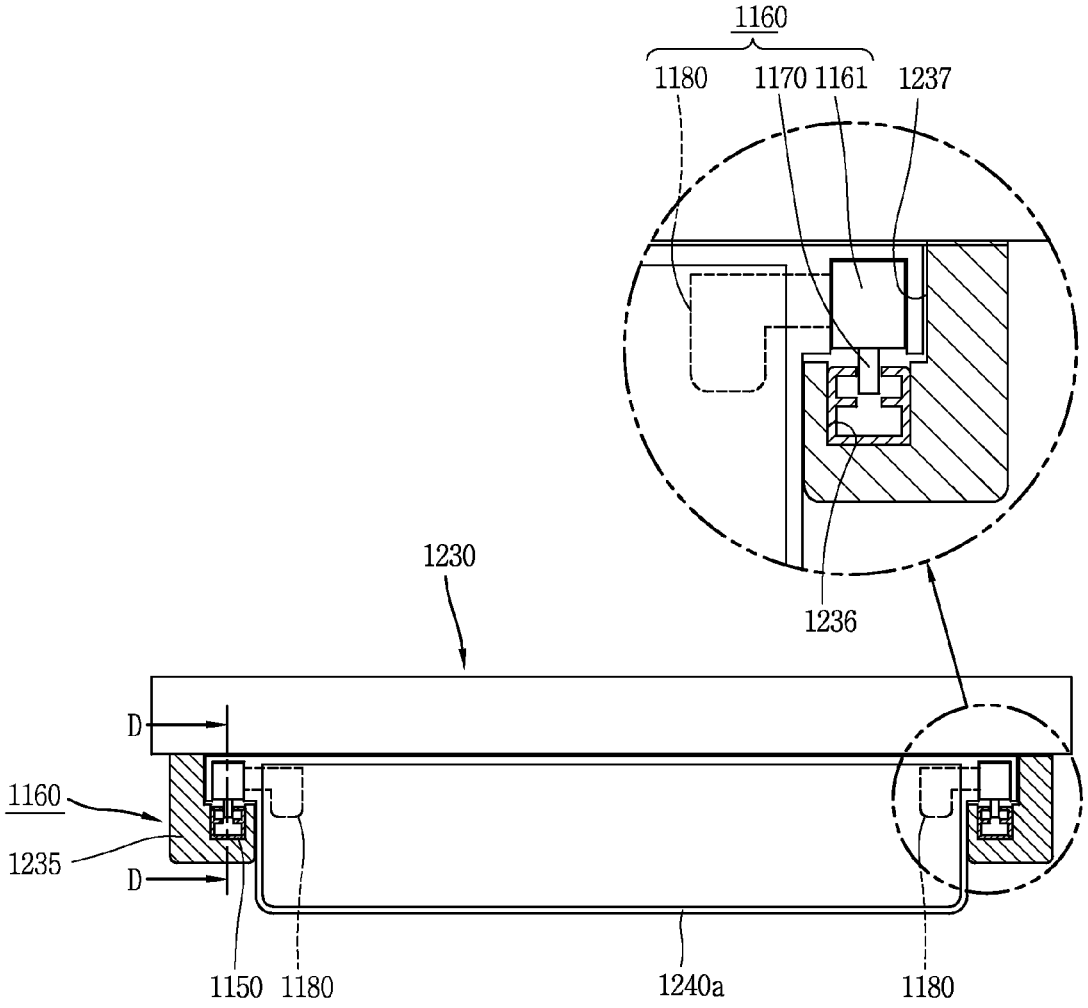
FIG. 26 is a plan view of a coupled state of a basket in FIG. 25.
Figure 27:
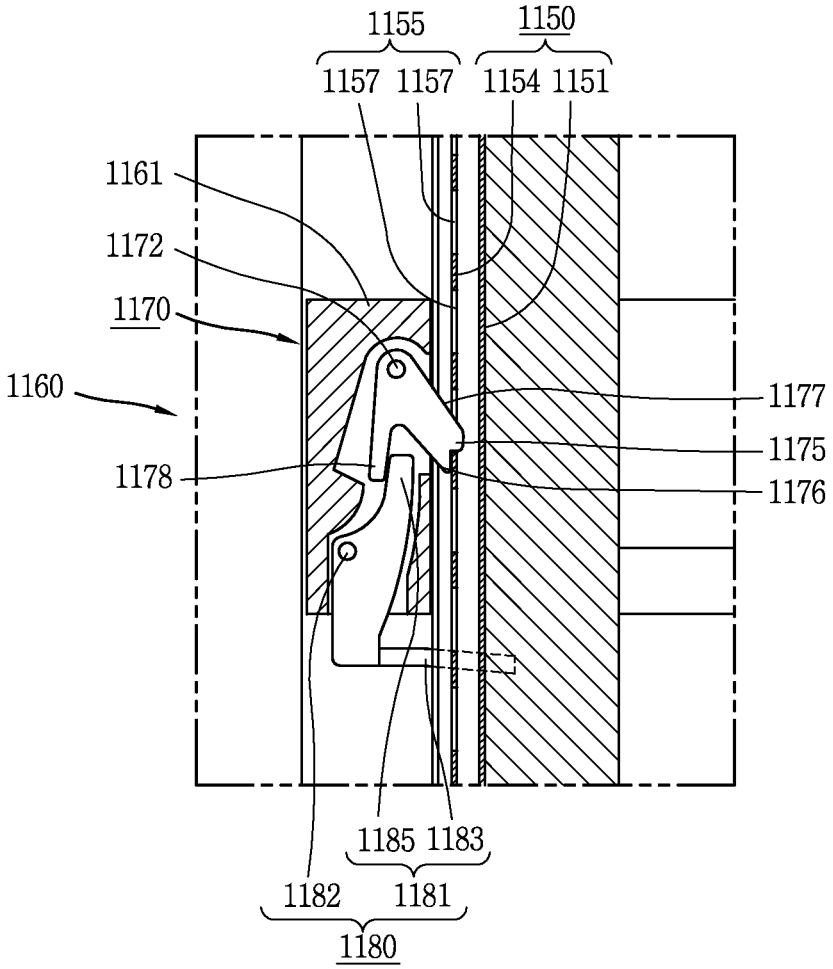
FIG. 27 is a perspective view of a separated state of the basket in FIG. 25.
Figure 28:
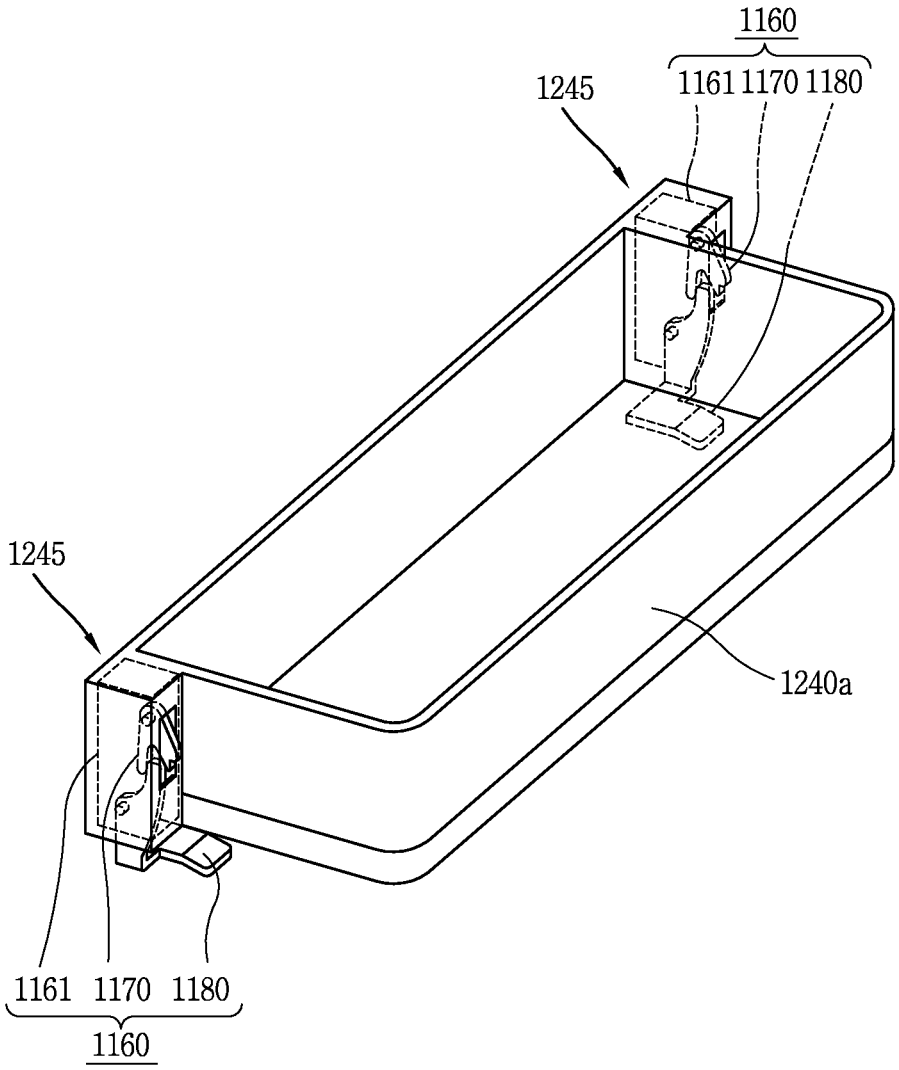
FIG. 28 is a sectional view taken along line D-D in FIG. 26.

As shown in FIG. 25, a refrigerator according to another embodiment of the present invention may include a refrigerator main body 1210 having a cooling chamber 1220 provided therein, a cooling chamber door 1230 for opening and closing the cooling chamber 1220, a basket 1240*a* provided in the cooling chamber door 1230 such that it ascends or descends, and the height adjusting unit 1160 for adjusting a height of the basket 1240*a*.

The refrigerator main body 1210 may be configured such that the cooling chamber 1220 is partitioned in a vertical direction.

The cooling chamber door 1230 may be provided at one side of the cooling chamber 1220 in order to open and close the cooling chamber 1220.

A plurality of baskets 1240*a* may be provided on an inner surface of the cooling chamber door 1230.

A dike 1235 supporting the baskets 1240*a* may be provided on the cooling chamber door 1230.

For example, the dike 1235 may be protruded from the inner surface of the cooling chamber door 1230 and extend in a vertical direction.

The rail 1150 may be provided in the dike 1235 in order to guide ascending and descending of the basket 1240*a*.

The rail 1150 may be configured to include the annular body 1151 having the slit 1152 formed at one side thereof in section.

The stop portion 1155 may be provided therein to make an engagement at a pre-set interval.

In detail, the stop portion 1155 may include a plurality of stop recesses 1157 formed to penetrate the partition 1154.

The dike 1235 may include a rail accommodation portion 1236 for accommodating the rail 1150.

A protrusion portion 1245 may be formed on both sides thereof such that it is protruded to the outside.

The protrusion portion 1245 may include the height adjusting unit 1160.

The height adjusting unit 1160 may include the latch 1170 rotatable between an engagement position at which the latch 1170 is engaged with the stop portion 1155 in a vertical direction and a release position at which the engagement is released, and a manipulation lever 1180 provided in one side of the latch 1170 and releasing the engagement of the latch 1170 when pressed.

The height adjusting unit 1160 may include the case 1161 forming an accommodation space therein.

The latch 1170 and the manipulation lever 1180 may be accommodated and coupled within the case 1161.

The handle portion 1183 of the manipulation lever 1180 may be exposed to the outside of the case 1161.

The case 1161 may be coupled to the protrusion portion 1245. Here, of course, the latch 1170 and the manipulation lever 11870 of the height adjusting unit 1160 may be directly coupled to the basket 1240*a*.

The dike 1235 may include an insertion portion 1237 to allow the protrusion portion 1245 to be inserted therein. The insertion portion 1237 may be formed by cut out a portion of an inner surface of the dike 1235 by a certain depth in a thickness direction. The insertion portion 1237 may extend in a vertical direction. Accordingly, the basket 1240*a* may ascend and descend up and down along the dike 1235.

The slit 1152 of the rail 1150 may be disposed toward the insertion portion 1237, and the latch 1170 may be provided on the protrusion portion 1245 such that the stop protrusion 1175 faces the slit 1152.

Meanwhile, at least one basket 1240*b* may be further provided in a pre-set position of the cooling chamber door 1230. In the present embodiment, two baskets 1240*a* in an upper region of the cooling chamber door 1230 are configured to ascend and descend, while two lower baskets 1240*b* are fixedly supported in a determined position, but of course, the lower baskets 1240*b* may also be configured to ascend and descend. Also, the number of height-adjustable baskets and the number of fixedly disposed baskets 1240*b* may be appropriately adjusted.

With such a configuration, when a position of the basket 1240*a* is intended to be raised, a bottom portion of the basket 1240*a* may be upwardly pressed so as to be disposed in a desired position.

Also, when a position of the basket 1240*a* is intended to be lowered, the basket 1240*a* may be lowered to a desired height in a state in which the handle portion 1183 of the manipulation lever 1180 is pressed. When the basket 1240*a* reaches a desired position, the pressing of the handle portion 1183 of the manipulation lever 1180 may be released.

As described above, according to embodiments of the present invention, since the panel, the protrusions formed on both sides of the panel such that they move forwardly and backwardly, the guide for guiding ascending and descending of the protrusions, and the height adjusting unit for adjusting a height of the panel by moving the protrusions forwardly and backwardly, are provided, a height of a shelf or a vertical interval between shelves can be adjusted without having to take out a food item placed on an upper surface of a shelf.

In addition, a height of a shelf can be finely or minutely adjusted by adjusting a degree of a forward or backward movement of the protrusions.

In addition, since a height of a shelf is configured to be adjusted manually, the cost can be reduced without using a high-priced electric component.

In addition, since an electric component is not used, power consumption cannot be increased.

In addition, since an electric component is not used, a defective operation resulting from a fault of an electric component can be prevented.

In addition, since the entrance allowing the protrusions to enter or exit is provided on the guide, a shelf can be simply separated and assembled.

In addition, since a shelf can be simply separated from or assembled to the guide, the guide and the shelf can be easily cleaned.

In addition, since the basket disposed to ascent and descent in the refrigerator main body or in the cooling chamber door and the height adjusting unit for adjusting a height of a basket are provided, a height of the basket can be adjusted according to a height of an article or a food item received or kept therein, and thus, receiving or keeping food items is facilitated.

In addition, since a basket ascends or descends along the rail, the basket can be smoothly moved.

In addition, when a bottom portion of the basket is upwardly pressed so as to be placed in a desired position in case of ascending, an adjustment of an ascending position of the basket is completed, and when the basket is lowered to a desired position in a state in which the manipulation lever is pressed in case of descending, an adjustment of a descending position of the basket is completed. Thus, a height of the basket can be promptly and simply adjusted.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a refrigerator main body having a freezing chamber and a refrigerating chamber;

a freezing chamber door to open and close the freezing chamber; and a first refrigerating chamber door to open and close the refrigerating chamber, wherein the first refrigerating chamber door includes an opening such that a food item is received and/or taken out through the opening without opening the first refrigerating chamber door; and a second refrigerating chamber door provided at the first refrigerating chamber door to open and close the opening of the first refrigerating chamber door; and a basket installed at the opening of the first refrigerating chamber door such that a height thereof is adjustable;

rails provided at a rear surface of both side walls of the opening of the first refrigerating chamber door so as to be configured to face the refrigerating chamber to guide ascending and descending of the basket, the rails spaced apart from one another and each extending in a vertical direction; and a height adjusting unit installed at the basket and engaged with each rail so as to adjust a height of the basket ascended and descended, wherein the height adjusting unit includes a manipulation lever having a handle portion exposed toward outside through the opening of the first refrigerating chamber door.

2. The refrigerator of claim 1, wherein the rail comprises:

an annular body having a slit formed in the vertical direction on one side facing the refrigerating chamber and forming an internal space therein; and a partition disposed within the annual body to partition the internal space of the rail, wherein the partition has stop portions formed in a pre-set interval.

3. The refrigerator of claim 2, wherein the stop portions include a stop recess formed to penetrate the partition.

4. The refrigerator of the claim 3, wherein the height adjusting unit comprises a latch rotatable between an engagement position in which the latch is engaged with the stop recess and a release position in which the latch is released from the stop recess.

5. The refrigerator of claim 4, wherein the latch comprises:

a stop protrusion configured to be inserted into the stop recess; and a stopper formed on a lower side of the stop protrusion and configured to comes in contact with the partition of the rail when the stop protrusion is inserted into the stop recess.

6. The refrigerator of claim 5, wherein the latch further comprises a sloped portion formed on an upper side of the stop protrusion and upwardly sloped toward a rotational shaft of the latch.

7. The refrigerator of claim 6, wherein the sloped portion is brought into contact with an upper edge portion of the stop recess of the stop portions when the basket is upwardly pressed and the latch is pressed and rotated on the rotational shaft of the latch.

8. The refrigerator of claim 2, wherein the basket further comprises a support portion having one side inserted into the rail to movably support the basket.

9. The refrigerator of claim 8, wherein the support portion is configured to be inserted into the internal space through the slit of the rail such that the basket could be supported by the support portion and moves along the slit in a vertical direction.

10. The refrigerator of claim 9, wherein:

the one side of the support portion has a roller inserted into the rail, and the roller rollably comes in contact with the partition of the rail.

11. The refrigerator of claim 10, wherein:

the roller of the support portion is disposed within one of the internal space of the rail formed by the partition, and the roller rollably comes in contact with the partition and a portion of the annular body of the rail facing the refrigerating chamber.

12. The refrigerator of claim 4, wherein the latch further comprises an elastic member to apply elastic force to move the latch towards the stop portions.

13. The refrigerator of claim 4, wherein the manipulation lever comprises:

a rotational shaft; and a manipulation main body configured to be rotated on the rotational shaft, the handle portion formed at one side of the manipulation main body and configured to rotate the manipulation main body when pressed, and wherein the manipulation main body comprises a driving arm formed at the other side of the manipulation main body and configured to press the latch to be rotated when the handle portion is pressed.

14. The refrigerator of claim 13, wherein the handle portion and the driving arm are formed at lower and upper sides of the rotational shaft, respectively.

15. The refrigerator of claim 13, wherein the driving arm is configured to be spaced apart from the handle portion and extends toward an operating portion of the latch to come in contact with the operating portion.

16. The refrigerator of the claim 15, wherein the driving arm configures to be bent toward the operating portion of the latch from a center of the manipulation lever main body such that a center of the driving arm is disposed at a center of the latch.

17. The refrigerator of claim 15, wherein the operating portion is configured to extend from a rotational shaft of the latch in a downward direction.

18. The refrigerator of claim 15, wherein the handle portion is spaced apart from the driving arm in a lateral direction and disposed below a bottom portion of the basket.

19. The refrigerator of claim 1, wherein a center of the manipulation lever is spaced apart from a center of the rail.

20. The refrigerator of claim 4, wherein the manipulation lever comprises a driving arm associating with the latch, and wherein the handle portion is spaced apart from the driving arm in a lateral direction and disposed below a bottom portion of the basket.

* * * * *